US006714749B2

(12) United States Patent
Sato et al.

(10) Patent No.: US 6,714,749 B2
(45) Date of Patent: Mar. 30, 2004

(54) CARTRIDGE DETACHABLY MOUNTABLE ON IMAGE FORMING APPARATUS

(75) Inventors: Minoru Sato, Shizuoka (JP); Teruhiko Sasaki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/171,630

(22) Filed: Jun. 17, 2002

(65) Prior Publication Data

US 2003/0002883 A1 Jan. 2, 2003

(30) Foreign Application Priority Data

Jun. 18, 2001 (JP) ..... 2001/183663

(51) Int. Cl.[7] ..... G03G 15/08; G03G 21/00

(52) U.S. Cl. ..... 399/102; 399/105; 399/284; 399/351

(58) Field of Search ..... 399/102, 103, 399/105, 106, 109, 110, 111, 114, 119, 274, 284, 350, 351

(56) References Cited

U.S. PATENT DOCUMENTS

| | | | | |
|---|---|---|---|---|
| 5,331,373 A | | 7/1994 | Nomura et al. | 355/200 |
| 5,452,056 A | | 9/1995 | Nomura et al. | 355/200 |
| 5,502,547 A | * | 3/1996 | Shirai | 399/102 |
| 5,528,341 A | | 6/1996 | Shishido et al. | 355/200 |
| 5,585,889 A | | 12/1996 | Shishido et al. | 355/200 |
| 5,870,654 A | | 2/1999 | Sato et al. | 399/109 |
| 5,911,096 A | | 6/1999 | Batori et al. | 399/111 |
| 5,920,753 A | | 7/1999 | Sasaki et al. | 399/111 |
| 5,940,658 A | | 8/1999 | Yokoi et al. | 399/119 |
| 5,966,566 A | | 10/1999 | Odagawa et al. | 399/109 |
| 5,974,288 A | | 10/1999 | Sato | 399/119 |
| 6,104,894 A | | 8/2000 | Sato et al. | 399/106 |
| 6,118,957 A | | 9/2000 | Fujiwara et al. | 399/103 |
| 6,131,007 A | | 10/2000 | Yamaguchi et al. | 399/256 |
| 6,137,971 A | | 10/2000 | Sasaki et al. | 399/106 |
| 6,137,973 A | | 10/2000 | Nishiuwatoko et al. | 399/111 |
| 6,141,508 A | | 10/2000 | Sasaki et al. | 399/27 |
| 6,178,302 B1 | | 1/2001 | Nagashima et al. | 399/106 |
| 6,183,075 B1 | | 2/2001 | Sasaki | 347/86 |
| 6,188,856 B1 | | 2/2001 | Sato | 399/119 |
| 6,327,448 B1 | | 12/2001 | Sasaki | 399/111 |
| 2002/0034398 A1 | * | 3/2002 | Higeta et al. | 399/109 |

FOREIGN PATENT DOCUMENTS

| | | |
|---|---|---|
| JP | 11-102105 | 4/1999 |

* cited by examiner

*Primary Examiner*—Joan Pendegrass
(74) *Attorney, Agent, or Firm*—Fitzpatrick, Cella, Harper & Scinto

(57) ABSTRACT

A cartridge detachably mountable on an image forming apparatus, including a frame and a blade member held by the frame, wherein a double-sided adhesive tape is stuck between the frame and the blade member along the lengthwise direction of the blade member.

10 Claims, 29 Drawing Sheets

CARTRIDGE DETACHABLY MOUNTABLE ON IMAGE FORMING APPARATUS

BACKGROUND OF THE INVENTION

1. Field of the Invention

The invention relates to an cartridge mounted on an image forming apparatus such as a copying machine or a printer for forming an image by the use of a recording technique of the electrophotographic type, the electrostatic recording type or the like.

2. Description of Related Art

As a cartridge mounted on an image forming apparatus, there is, for example, one which comprises a photosensitive member, a charger, a developing device and a cleaner made into a unit. Besides this, there is one which is divided into a cartridge holding a photosensitive member and a cartridge holding a developing device.

As described above, the main portion of the image forming apparatus is made into a simply interchangeable cartridge and thus, even an ordinary user can effect the maintenance of the apparatus.

In present day image forming apparatuses, a powdered toner is generally used as a developer for depicting an image on recording paper. Because of being powder, the toner is liable to leak and particularly, a cartridge containing the toner therein is given vibration by the user handling and therefore the toner is liable to leak therefrom. For this reason various contrivances have been made so that the toner may not leak.

FIG. 27 of the accompanying drawings shows a cross-sectional view of a cartridge P which will be instructive for understanding the present invention. This cartridge P carries therein, as main constituents, a photosensitive member 103, a charging roller 104 for charging the photosensitive member 103, a developing roller 105 bearing thereon a toner for developing an electrostatic latent image formed on the photosensitive member, a cleaning blade 106 abutting against the photosensitive member to thereby clean the photosensitive member, and a shutter 107 for protecting the photosensitive member. The reference numeral 108 designates a toner containing chamber, the reference numeral 109 denotes a developing chamber, the reference numeral 110 designates an opening for connecting the toner containing chamber and the developing chamber together, the reference numeral 111 denotes a seal for closing the opening 110 (this seal is stripped off when the cartridge begins to be used), the reference numeral 112 designates a layer thickness regulating blade (developing blade) for regulating the layer thickness of the toner formed on the developing roller 105, and the reference numeral 113 denotes end portion seals for preventing the leakage of the toner from the opposite ends of the developing roller.

FIG. 29 of the accompanying drawings is an exploded view and an assembly view of a frame forming the toner containing chamber and the developing chamber. As shown in FIG. 29, the toner containing chamber and the developing chamber are formed by superposing frame parts 101 and 102 made of synthetic resin one upon the other. The frame parts 101 and 102 are coupled together by a coupling method such as ultrasonic welding, whereby the leakage of the toner from the gap between the two is prevented.

Now, the developing blade 112 comprises a blade 112*a* made of rubber and attached to a support member 112*b* made of a metal by such means as adhesive securing, and the lengthwisely opposite end portions of the support member 112*b* of the developing blade 112 are fixed to the frame part 101 by screws 114. FIGS. 26A and 26B of the accompanying drawings show enlarged views of the attached portion of the developing blade. Between the frame part 101 and the developing blade 112, an elastic seal 115 such as foamed polyurethane is compressed and sandwiched as shown in FIG. 26A, or a portion 101*a* of the frame part 101 is caused to eat into the blade 112*a* as shown in FIG. 26B, to thereby prevent the leakage of the toner from between the developing blade 112 and the frame part 101.

FIG. 28A of the accompanying drawings is a cross-sectional view of the lengthwisely central portion of a cartridge, and this cartridge somewhat differs in shape from the cartridge shown in FIG. 27, but is substantially the same as the cartridge of FIG. 27 in the structure of the attached portion of the developing blade. The reference numeral 116 designates a toner agitating member provided in the toner containing chamber, and this toner agitating member 116 is rotated so that the tip end 116*a* thereof may describe a locus indicated by dot-and-dash line. Although not shown, on the left side of FIG. 28A, the photosensitive member, the cleaner, etc. are mounted as in FIG. 27.

When as shown in FIG. 28A, the user holds the cartridge in his hand H, the frame is sometimes deformed by the force thereof as shown in FIG. 28B of the accompanying drawings. When the frame is deformed, a gap is created between the developing blade 112 and the frame part 101 as shown in FIG. 28B, and in the case of the seal construction as shown in FIG. 26B, the toner leaks from this gap (this gap is largest in the central portion of the developing blade which is not fixed by a screw because the lengthwisely opposite ends of the developing blade are fixed to the frame by the screws 114). Even when the elastic seal 115 is sandwiched between the developing blade 112 and the frame part 101 as shown in FIG. 26A, a gap may be formed between the elastic seal 115 and the developing blade 112. Also, even if a gap is not formed and the leakage of the toner can be prevented, a portion of the frame part 101 may contact which the toner agitating member 116 mounted in the toner containing chamber 108 due to the deformation of the frame part 101 and may damage the tip end 116*a* thereof. Even when due to the deformation of the frame, the toner agitating member and the frame do not interfere with each other, the deformation of the frame is not preferable in the sealing performance of the cartridge. It would occur to mind to make the thickness of the frame great in order to prevent the deformation of the frame, but this method will result in the increased weight of the cartridge.

In the case of the cartridge handled by the user, as described above, the compatibility of the increased sealing performance between the blade member and the frame and the increased rigidity of the frame is required.

SUMMARY OF THE INVENTION

The present invention has been made in view of the above-noted problem and an object thereof is to provide a cartridge which achieves the compatibility of the increased sealing performance between a blade member and a frame and the increased rigidity of the frame.

Another object of the present invention is to provide a cartridge which achieves the compatibility of the increased sealing performance between a blade member and a frame and the increased rigidity of the frame by a simple method.

Still another object of the present invention is to provide a cartridge comprising:

a frame; and a blade member held by the frame;

wherein a double-sided adhesive tape is stuck between the frame and the blade member along the lengthwise direction of the blade member.

Further objects of the present invention will become apparent from the following detailed description when read with reference to the accompanying drawings.

DETAILED DESCRIPTION OF THE PREFERRED EMBODIMENTS

An embodiment of the present invention will hereinafter be described in detail with reference to the drawings. In the following description, the lengthwise direction of a process cartridge is a direction intersecting with (substantially orthogonal to) the transport direction of a recording medium. Also, left or right is left or right as the recording medium is viewed from above in accordance with the transport direction of the recording medium. Also, the upper surface of the process cartridge is a surface overlying in a state in which the process cartridge is mounted on the main body of an apparatus, and the underside of the process cartridge is an underlying surface.

Figure 1:
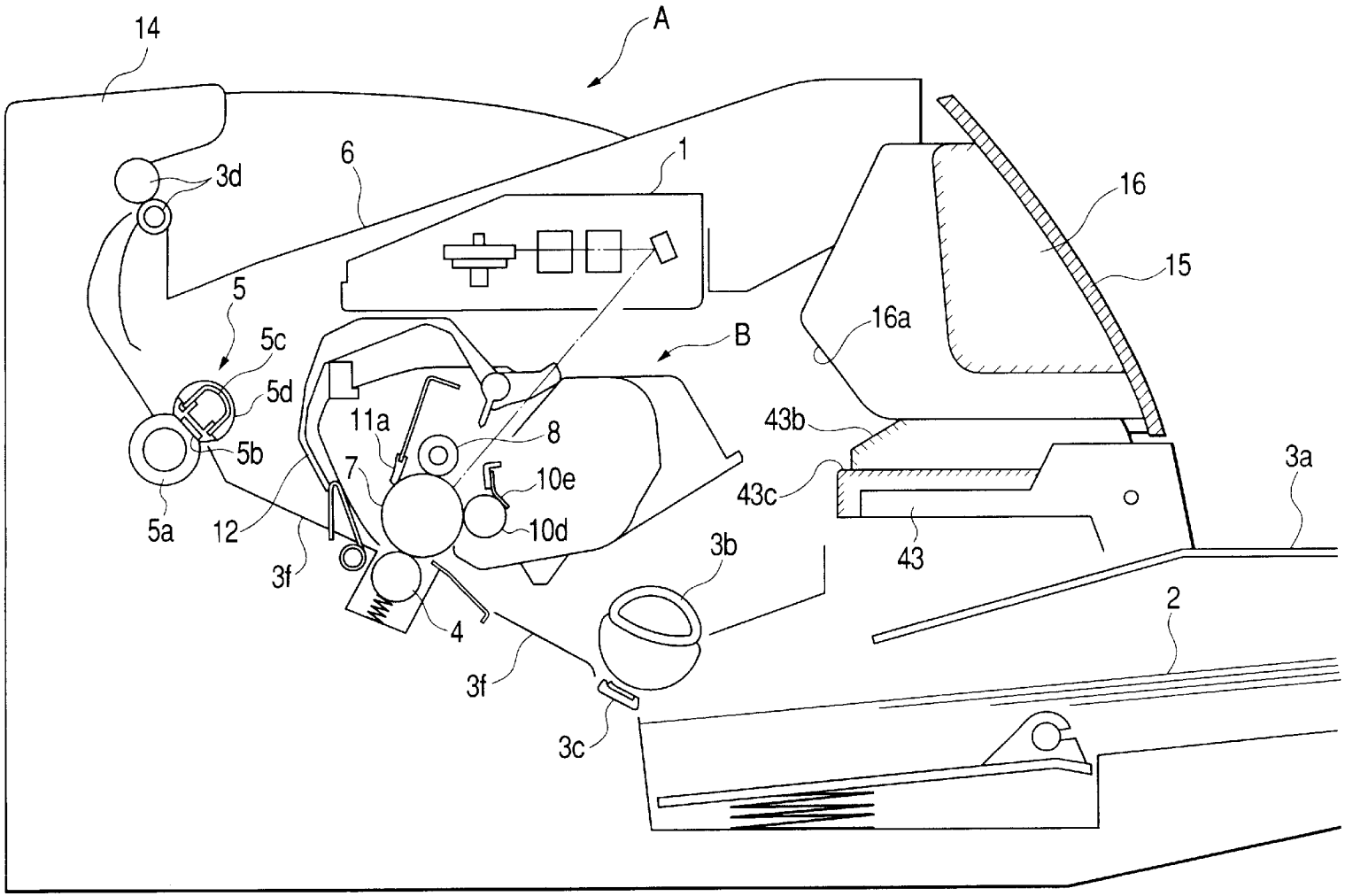
FIG. 1 is a cross-sectional view schematically showing the construction of an electrophotographic image forming apparatus.
Figure 2:
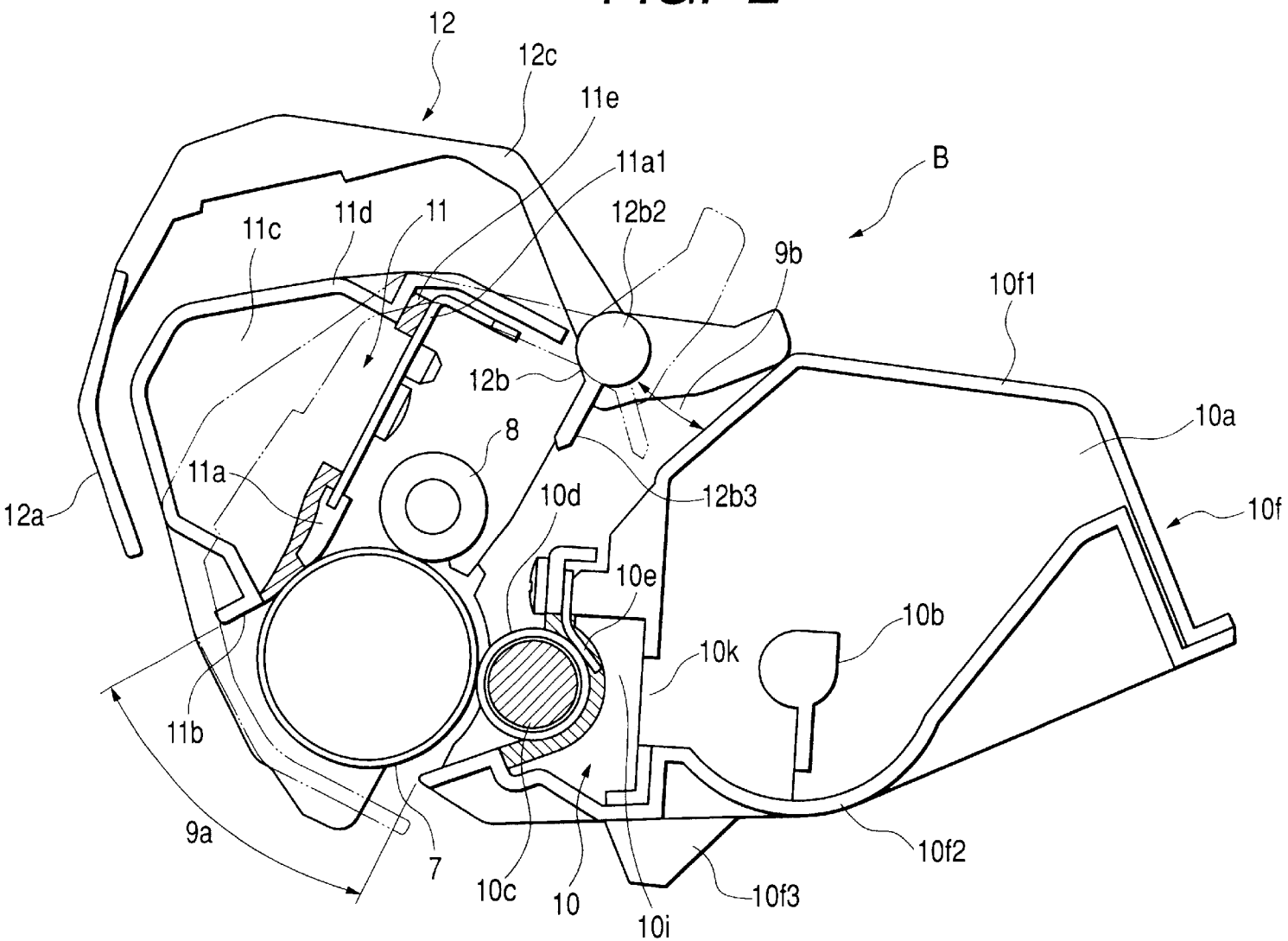
FIG. 2 is a cross-sectional view schematically showing the construction of a process cartridge.

The process cartridge and an electrophotographic image forming apparatus having it mounted thereon will first be specifically described with reference to FIGS. 1 and 2. FIG. 1 is a typical illustration of the construction of the electrophotographic image forming apparatus having the process cartridge mounted thereon, and FIG. 2 is a typical illustration of the construction of the process cartridge. Herein, as the order of description, the process cartridge and the general construction of the electrophotographic image forming apparatus using the same will first be described, and then the construction of a process cartridge mounting and dismounting mechanism for mounting and dismounting the process cartridge on and from the main body of the electrophotographic image forming apparatus will be described.

(General Construction)

This electrophotographic image forming apparatus (laser beam printer, hereinafter referred to as the "image forming apparatus") A, as shown in FIG. 1, applies image light based on image information from an optical system 1 as optical means to a drum-shaped electrophotographic photosensitive member (image bearing member, hereinafter referred to as the "photosensitive drum") 7 to thereby form an electrostatic latent image on the photosensitive drum 7, and develops this electrostatic latent image by a developer (hereinafter referred to as the toner to thereby form a toner image. Then, in synchronism with the formation of the toner image, recording media (such as recording paper, OHP sheets or cloth) 2 are separated and fed one by one from a cassette 3*a* by a pickup roller 3*b* and a pressure contact member 3*c* being in pressure contact therewith, and a voltage is applied to a transfer roller 4 as transferring means to thereby transfer the toner image formed on the photosensitive drum 7 in the process cartridge B to the recording medium 2, which is transported to fixing means 5 by a transport guide 3*f*. This fixing means 5 comprises a driving roller 5*a* and a fixing rotary member 5*d* containing a heater 5*b* therein and comprised of a cylindrical sheet rotatably supported by a support member 5*c*, and applies heat and pressure to the passing recording medium 2 to thereby fix the transferred toner image. This recording medium 2 is transported by delivery rollers 3*d* and is delivered to a delivery portion 6 through a surface reverse transport path. In the present embodiment, transporting means is constituted by the pickup roller 3*b*, the pressure contact member 3*c*, the delivery rollers 3*d*, etc.

(Process Cartridge)

On the other hand, the process cartridge B is provided with the electrophotographic photosensitive member and at least one process means. As the process means, there are, for example, charging means for charging the electrophotographic photosensitive member, developing means for developing the electrostatic latent image formed on the electrophotographic photosensitive member, cleaning means for removing any toner residual on the electrophotographic photosensitive member, etc. The process cartridge B of the present embodiment is designed such that as shown in FIG. 2, the photosensitive drum 7 which is an electrophotographic photosensitive member having a photoconductive layer is rotated, and a voltage is applied to a charging roller 8 which is charging means to thereby uniformly charge the surface of the photosensitive drum 7, and this charged photosensitive drum 7 is exposed to image light (optical image) based on the image information from the optical system 1 through an exposure opening 9*b* to thereby form an electrostatic latent image on the surface of the photosensitive drum 7, and this electrostatic latent image is developed by developing means 10.

The developing means 10 feeds the toner in a toner containing portion 10*a* by a rotatable feed member 10*b* which is toner feeding means. The developing roller 10*d* which is a developing rotary member (developer carrying member) containing a stationary magnet 10*c* therein is rotated and also, a toner layer having triboelectrification charges induced therein by a developing blade 10*e* for regulating the layer thickness of the toner carried on the developing roller 10*d* is formed on the surface of the developing roller 10*d*, and the toner is shifted to the photosensitive drum 7 in conformity with the electrostatic latent image to thereby form a toner image as a visible image.

A voltage opposite in polarity to the toner image is applied to the transfer roller 4 to thereby transfer the toner image to the recording medium 2, where after any residual toner on the photosensitive drum 7 is removed by cleaning means 11 for scraping off the toner residual on the photosensitive drum 7 by a cleaning blade 11*a*, and also dipping the toner by a dip sheet 11*b* and collecting the toner into a removed toner containing portion 11*c*.

The process cartridge B shown in the present embodiment comprises a cleaning frame 11*d* (second part) which rotatably supports the photosensitive drum 7 and into which the cleaning means 11 and the charging roller 8 are incorporated, and a toner developing frame 10*f* (first part) into which the developing means 10 and the toner containing portion 10*a* are incorporated. The toner developing frame 10*f* is supported for pivotal movement relative to the cleaning frame 11*d* so that the developing roller 10*d* of the developing means 10 can be opposed to the photosensitive drum 7 in parallel to the latter with a predetermined interval therebetween, and spacers 10*m* (see FIG. 11) for maintaining the interval between the developing roller 10*d* and the photosensitive drum 7 are disposed at the opposite end portions of the developing roller 10*d*. There are holder members 10*g* on the opposite sides of the toner developing frame 10*f*, and they have arm portions 10*g*7 formed with coupling holes 10*g*8 for rotatably suspending a developing unit on a cleaning unit. A predetermined pressure force is applied to between the developing unit and the cleaning unit to maintain an interval therebetween.

Figure 3:
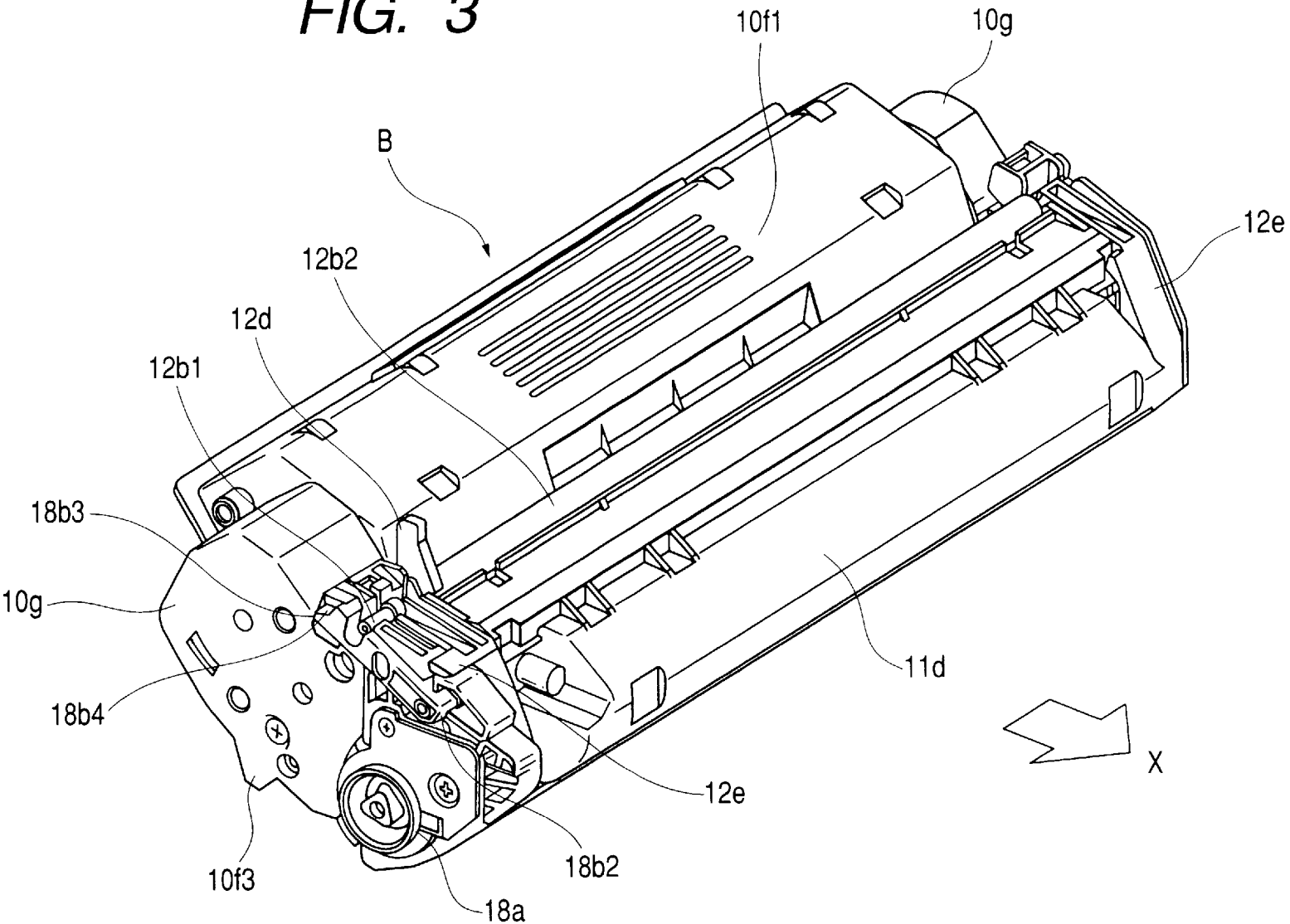
FIG. 3 is a perspective view of the process cartridge.
Figure 4:
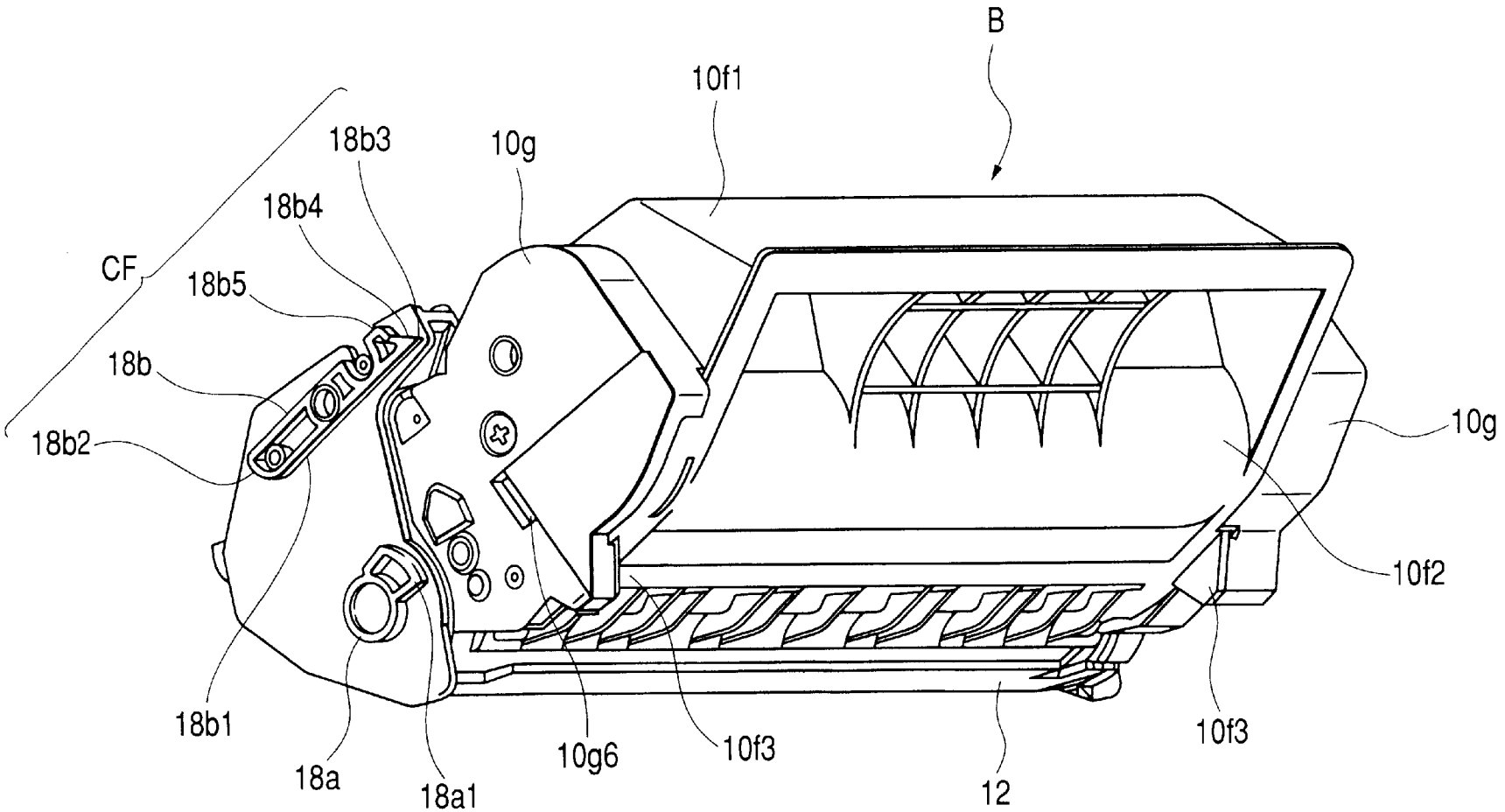
FIG. 4 is a perspective view of the process cartridge.

The frame CF of the process cartridge B comprises the toner developing frame 10*f* (first past) comprising a developing frame 10*f*1 and a lid member 10*f*2 welded together into a unit and the cleaning frame 11*d* (second part) coupled together. As shown in FIGS. 3 and 4, on the lengthwisely opposite sides of this cartridge frame CF, there are provided a mounting guide 18*b* for detachably mounting the process cartridge in the direction indicated by the arrow X to the main body 14 of the electrophotographic image forming apparatus (hereinafter referred to as the main body 14 of the image forming apparatus), and a positioning portion 18*a* present coaxially with the rotary shaft of the photosensitive drum 7 and supported by positioning means in the interior of the image forming apparatus. The positioning portion 18*a* is a cylindrical boss differing in diameter at the left and right thereof, and the positioning portion thereof on the non-driving side has an arcuate projected portion 18*a*1 whose center is on the rotary shaft of the photosensitive drum 7 and having a radius larger than that of the positioning portion 18*a*. The mounting guide 18*b* has an underside 18*b*1 received by a movable guide 41 which will be describe later, and a distal end portion 18*b*2 which is the distal end of the mounting guide 18*b* in the direction of insertion of the process cartridge, and this distal end portion 18*b*2 is made such that the curvature of the arc thereof connected to the underside 18*b*1 is greater than the curvature of the arc thereof connected to the upper surface. A slope portion 18*b*4 forming an acute angle with the underside 18*b*1 is formed on the lower corner of the rear end which is the corner of the rear end of the underside 18*b*1 in the direction of insertion, and the rear end portion of the upper surface in the direction of insertion comprises an orthogonal surface 18*b*5 orthogonal to the upper surface. The rear end of the mounting guide 18*b* extends to the rear of the centroidal position of the process cartridge so that whenever the process cartridge B is supported by the mounting guide 18*b*, it may maintain a forwardly downwardly facing posture. In the present embodiment, the mounting guide 18*b* is provided on a side of the cleaning frame 11*d* and above the positioning portion 18*a*. The mounting guide 18*b*, however, may be provided on the toner developing frame 10*f* or a holder member 10*g* attached to a side thereof.

In the process cartridge B of the present embodiment, a drum shutter 12 capable of integrally covering the transfer opening 9*a* and exposure opening 9*b* of the photosensitive drum which are opposed to the transfer roller 4 is rotatably provided on the cleaning frame 11*d*. The construction of the drum shutter 12 will now be described. The drum shutter 12 has a drum protecting portion 12*a* capable of covering the transfer opening 9*a* through which the photosensitive drum 7 contacts with the transfer roller 4. On the rotary shaft 12*b* of the cleaning frame 11*d* which is to be rotatably supported near the exposure opening 9*b*, there are provided sliding portions 12*b*1 sliding relative to the cleaning frame 11*d* at the opposite ends of the rotary shaft 12*b*, a large-diametered portion 12*b*2 thicker than the sliding portions 12*b*1 in a portion connecting the sliding portions 12*b*1 at the opposite ends together and hanging on the exposure opening 9*b*, and an exposure shutter portion 12*b*3 for covering the exposure opening when the drum shutter 12 is closed on the large-diametered portion 12*b*2. The drum shutter 12 has connecting portions 12*c* provided at two left and right locations for connecting the opposite end portions of the drum protecting portion 12*a* and the large-diametered portion of the rotary shaft 12*b* outside thereof. It also has a cam portion 12*d* disposed on the right side of the large-diametered portion 12*b*2 of the rotary shaft 12*b* and protruding to the upper side of the process cartridge B. There is a rib 12*e* provided on the right connecting portion 12*c* and extending outwardly in the lengthwise direction of the drum shutter 12, and the rib 12*e* is received by the shutter guide 44*c* of a fixed guide 44, and the drum shutter 12 maintains its opened posture.

A biasing force is applied to this drum shutter 12 by the spring force of a shutter spring (see FIG. 6) in a direction in which the drum shutter 12 covers the photosensitive drum 7. Thereby, in a state in which the process cartridge B has been taken out of the main body of the apparatus, the drum shutter 12 maintains a state as indicated by double-dotted line in FIG. 2 wherein it is closed covering the transfer opening 9*a* of the photosensitive drum 7, and in a state in which the process cartridge B is in the main body of the apparatus and is capable of performing the image forming operation, the drum shutter 12 is rotated by drum shutter opening and closing means which will be described later, and assumes a posture as indicated by solid line in FIG. 2 wherein the transfer opening 9*a* is exposed and the photosensitive drum 7 and the transfer roller 4 become capable of contacting with each other therethrough.

Figure 14:
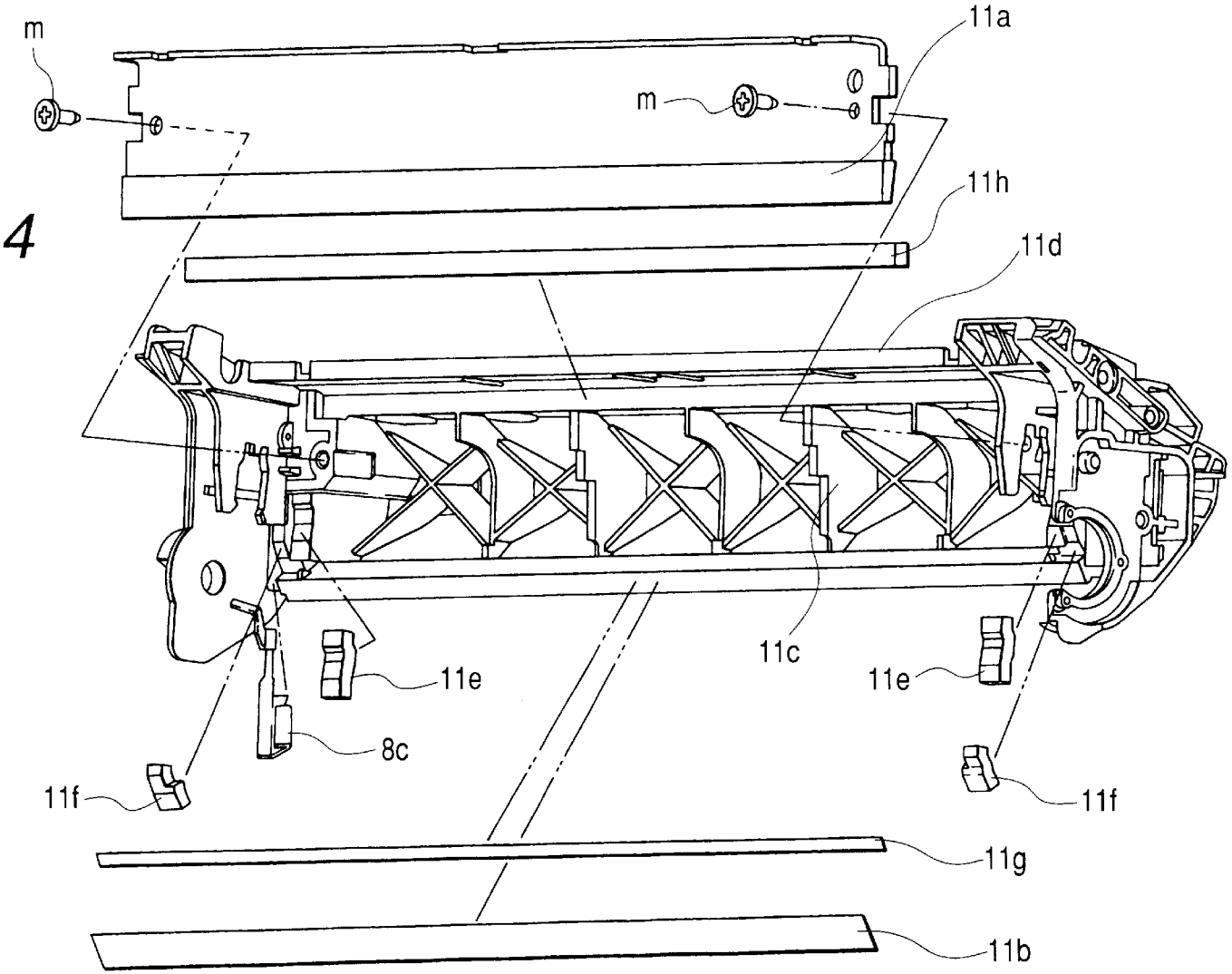
FIG. 14 is an exploded detailed view of the cleaning means.
Figure 15:
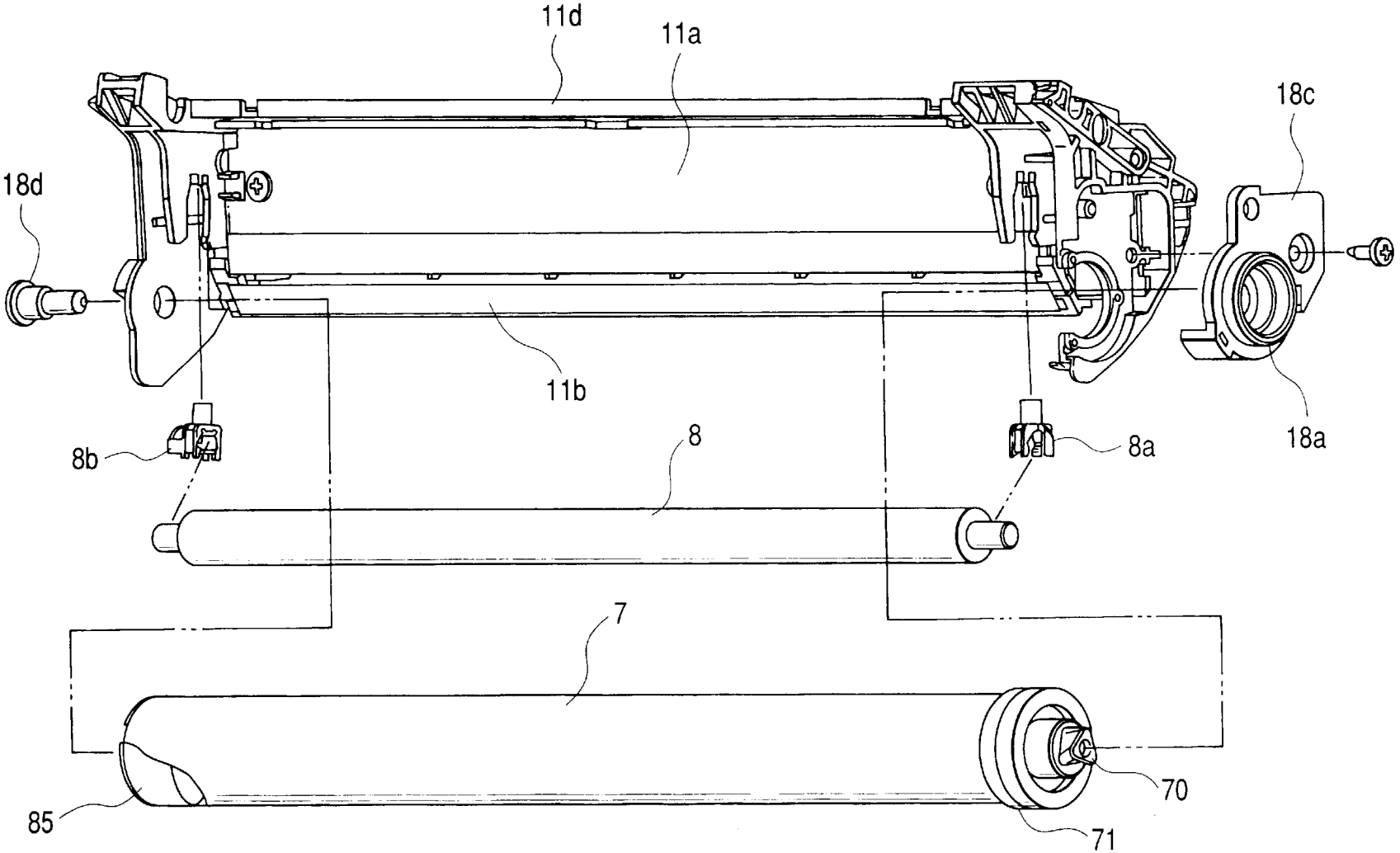
FIG. 15 is a detailed exploded view of the cleaning means.

The procedure of assembling the cleaning frame 11*d* having the cleaning means will now be described in detail with reference to FIGS. 14 and 15. The assembling of the cleaning means 11 is effected in the same order as will be described hereinafter.

The cleaning means 11 is such that a first seal member 11*e* for preventing the leakage of the toner from the back of the opposite ends of the rubber of the cleaning blade 11*a* from the removed toner containing portion 11*c* and a second seal member 11*h* for preventing the leakage of the toner from the back of the cleaning blade are fixed to predetermined locations on the cleaning frame 11*d* as by a double-sided adhesive tape. The cleaning blade 11*a* is fixed to a predetermined location on the cleaning frame 11*d* by a screw m. Further, a third seal member 11*f* as a member for preventing the leakage of the toner from the opposite ends of the rubber of the cleaning blade 11*a* and wiping off extraneous matter such as the toner on the photosensitive drum 7, and a dip sheet 11*b* which is a dip member are fixed to the cleaning frame 11*d* as by a double-sided adhesive tape 11*g*. Also, an electrode 8*c* for supplying electric power from the main body A of the image forming apparatus to the charging roller 8 is fitted in the cleaning frame.

Further, a roller bearing 8*b* for supplying electric power from the electrode 8*c* to the charging roller 8 and providing a bearing and another bearing 8*a* are incorporated in the cleaning frame 11*d*, and the shaft portion of the charging roller 8 is fitted in the bearings 8*b* and 8*a*.

The photosensitive drum 7 has coupled to one end thereof a drive transmitting coupling 70 and a drum gear 71 comprising a gear for transmitting a drive force to the developing roller 10*d* and the transfer roller 4, a grounding contact, etc. made integral with one another, and has coupled to the other end thereof a flange 85 having a bearing. The photosensitive drum 7 has a bearing 18*c* having the positioning portion 18*a* coupled to the coupling 70 side thereof by a screw, and has the other end forced into and supported by the cleaning frame 11*d* so that a positioning pin 18*d* may be within the positioning portion 18*a*.

The developing means 10 in the process cartridge B will now be described in greater detail.

Figure 9:
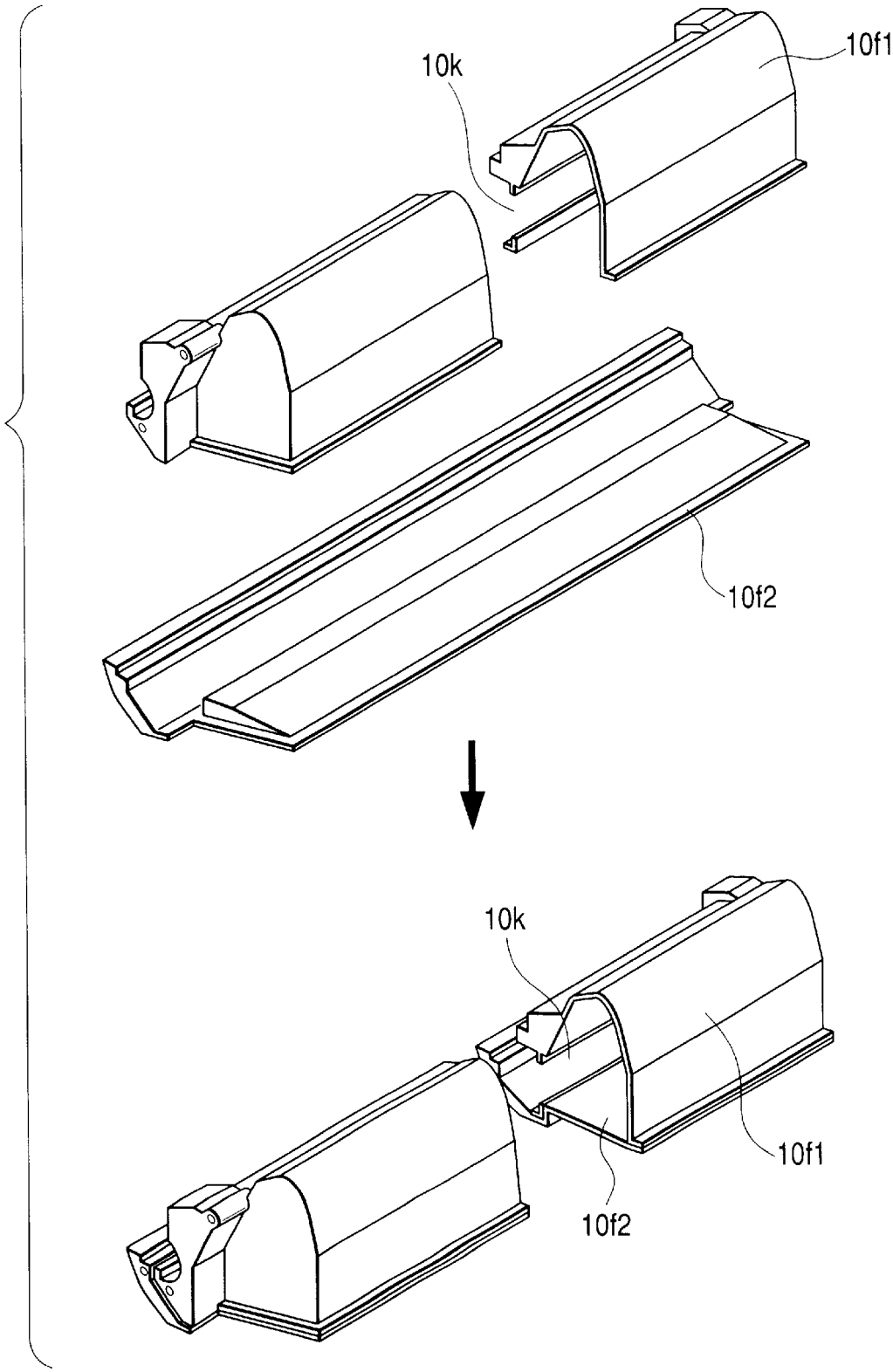
FIG. 9 is a view showing an assembly of a toner developing frame, a lid member and the toner seal member.

The developing means 10, as shown in FIGS. 2 and 9, is such that a toner developing frame 10*f*1 and a lid member 10*f*2 are coupled together to thereby constitute a toner chamber (toner containing portion) 10*a* and a developing chamber 10*i*.

Also, the toner developing frame 10*f*1 is formed with a toner passage opening 10*k* through which the toner contained in the toner chamber 10*a* passes when supplied to the developing roller 10*d*.

Figure 8A:
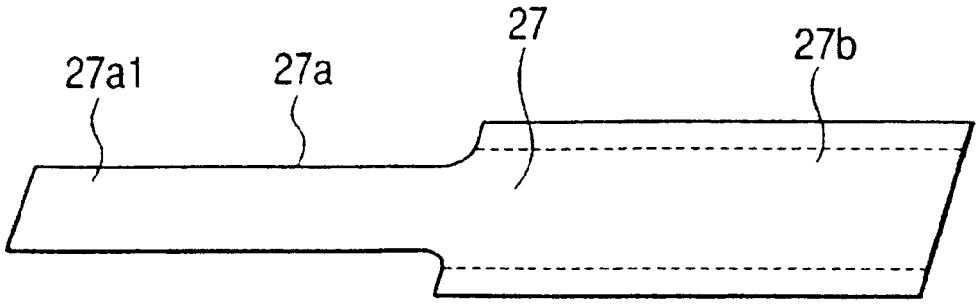
FIG. 8A PRIOR ART
FIG. 8A is a perspective view of a toner seal member.
Figure 8B:
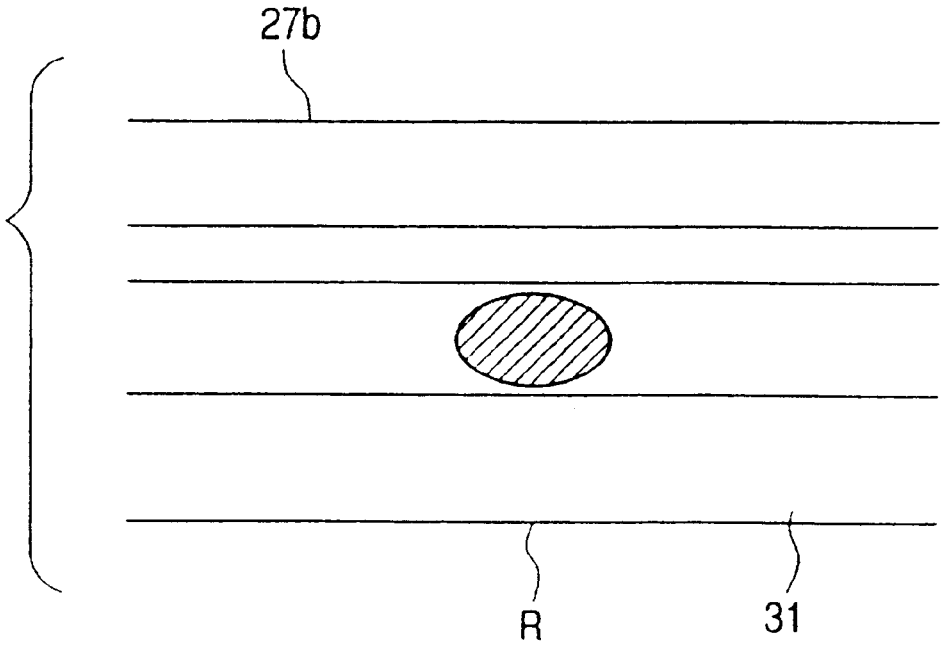
FIG. 8B PRIOR ART
FIG. 8B is an enlarged cross-sectional view of the toner seal member.

As shown in FIGS. 8A and 8B, a tearable cover film portion 27*b* is hot-welded by a laser beam to the seal mounting portion of a toner seal member 27 (see Japanese Patent Application Laid-Open No. 11-102105) comprising a plurality of layers closing the toner passage opening 10*k* of the toner developing frame 10*f*1, and this cover film portion 27*b* is provided with a sealant layer 31 for fixing the toner seal member 27.

Figure 10:
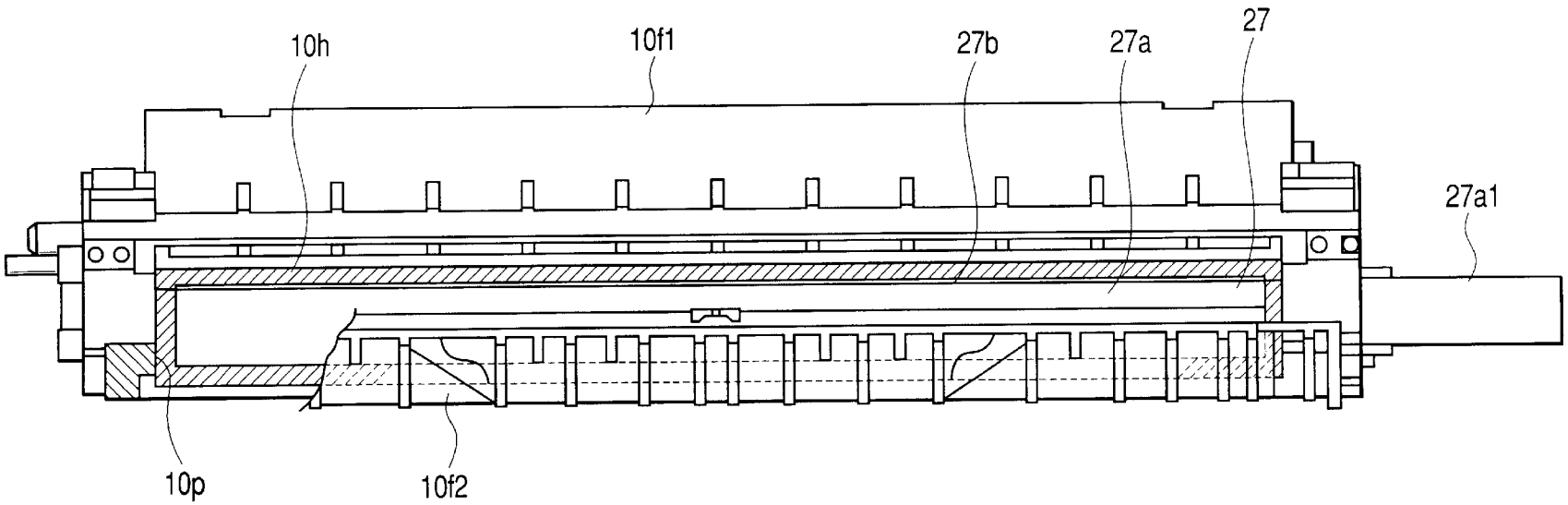
FIG. 10 is a schematic view showing a combination of the toner developing frame, the lid member and the toner seal member.

The toner seal member 27, as shown in FIG. 10, is stuck on the seal mounting portion 10*h* along the four side edges of the toner passage opening 10*k*, and this toner seal member 27 is half-cut-processed by the laser as previously described to unseal the toner passage opening 10*k* (Japanese Patent Application Laid-Open No. 11-102105).

Also, a toner pouring port (not shown) for pouring the toner into the toner chamber 10*a* therethrough is provided in one lengthwise end portion of the toner developing frame 10*f*1, and is sealed by a cap member 10*j* (see FIG. 11) after the toner has been poured.

The next assembling step will now be described with reference to FIGS. 9, 11 and 12. The developing means 10 is such that end portion seals 10*r* for preventing the leakage of the toner in the opposite end portions of the developing roller 10*d*, seal members 10*s* for preventing the leakage of the toner in the opposite end portions of the developing blade 10*e*, and a sheet member 10*t* for preventing the scattering of the toner from the gap in the lower portion of the developing roller 10*d* are stuck on the toner developing frame 10*f*1 and the lid member 10*f*2 by double-sided adhesive tapes or the like.

The developing blade 10*e* comprises an elastic blade 10*e*2 made of rubber and fixed to a metal plate 10*e*1 by an adhesive agent or a technique such as molding. A double-sided adhesive tape 62 for sealing the space between the elastic blade 10*e*2 of the developing blade 10*e* and that surface of the frame 10*f*1 on which the developing blade 10*e* is mounted is stuck on the aforementioned surface of the frame 10*f*1.

Thereafter the developing blade 10*e* has the opposite ends of its metal plate 10*e*1 fixed to the toner developing frame 10*f*1 by screws n. At this time, the tapered rib 66 of the toner developing frame 10*f*1 is set to such a dimension that it protrudes into the double-sided adhesive tape 62 which is an adhesive member having adhesive layers on both sides thereof and the rubber elastic blade 10*e*2 of the developing blade without fail, and the rubber elastic blade 10*e*2 and the toner developing frame 10*f*1 are sealed by the double-sided adhesive tape 62.

Figure 11:
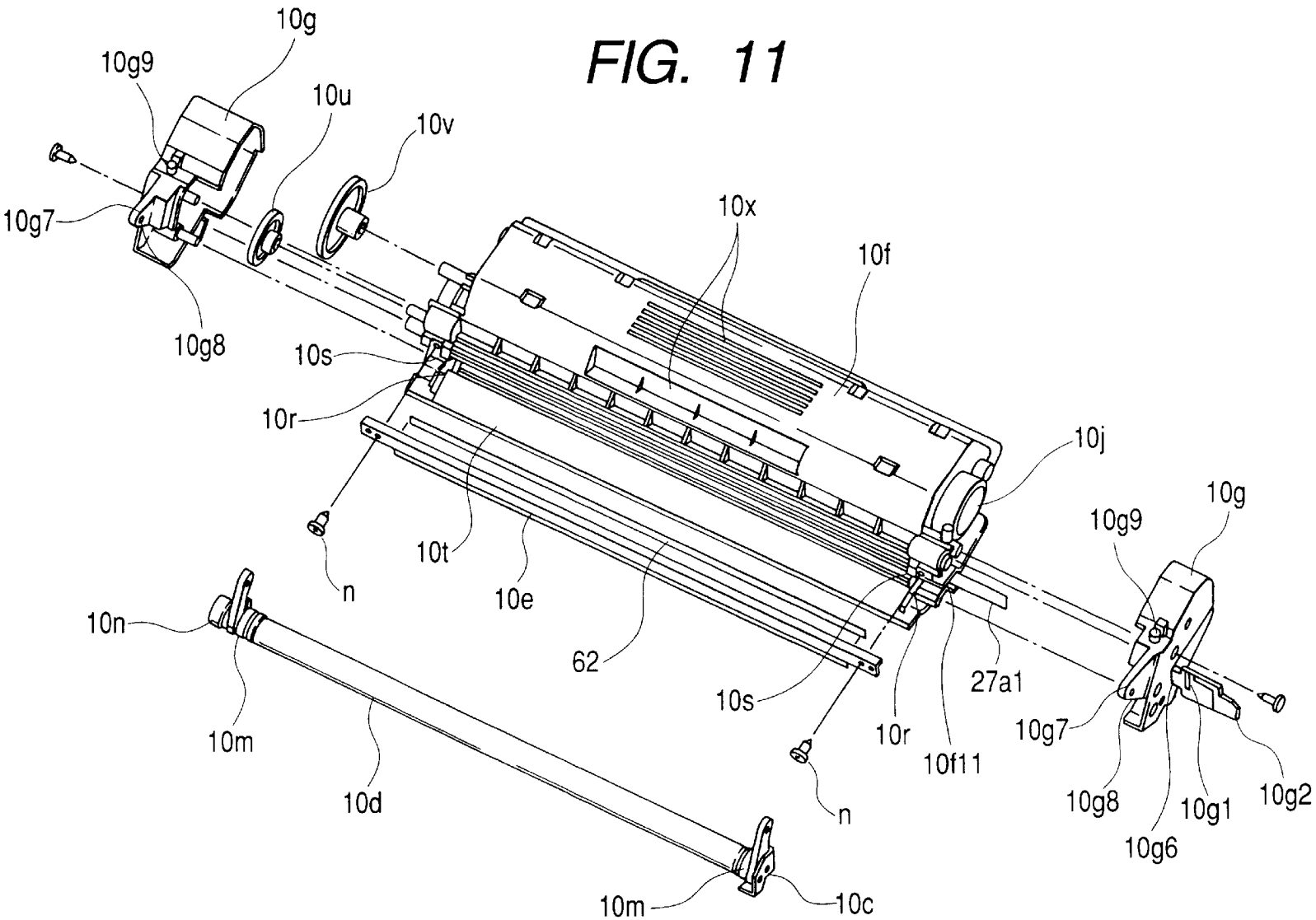
FIG. 11 is an exploded perspective view of the developing means.
Figure 12:
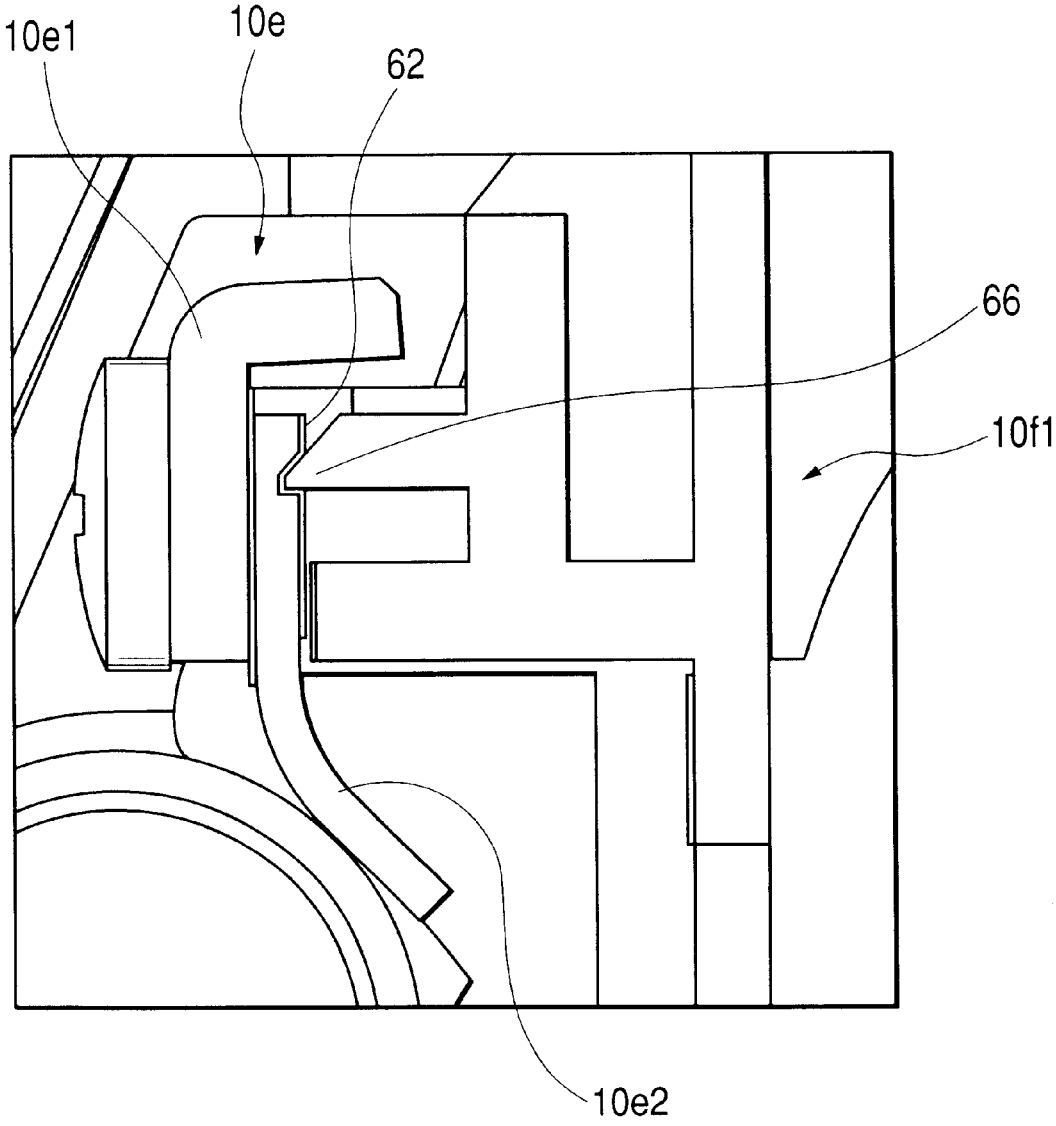
FIG. 12 is a cross-sectional view of the vicinity of a developing blade.

The length of the double-sided adhesive tape 62, as shown in FIG. 11, is substantially equal to the length of the elastic blade 10*e*2, and is somewhat smaller than the distance between the two screws n at the opposite ends of the developing blade.

As described above, the double-sided adhesive tape is provided between the developing blade and the frame and therefore, even if the user grasps a grip 10*x* (FIG. 11) provided on the lengthwisely central portion of the frame 10*f* and a force is applied to the frame 10*f*, the frame 10*f* (10*f*1) will not separate from the developing blade, and it will be understood that the leakage of the toner and the deformation of the frame are suppressed. That is, the compatibility of the improved seal performance and the improved rigidity of the frame can be achieved by a very simple construction in which the double-sided adhesive tape is provided between the developing blade and the frame.

(Construction of the End Portion Members and the Handle Member)

One of the end portion members (holder members), 10*g*, disposed on the lengthwisely opposite sides of the developing means 10 covers a gear train comprising a developing roller gear 10*n* (see FIG. 12) fixed to an end portion of the developing roller which is in meshing engagement with a drum gear (not shown) fixed to an end portion of the photosensitive drum 7, and two idler gears 10*u* and 10*v* for transmitting a drive force from the developing roller gear 10*n* to the transport gear (not shown) of the toner feed member 10*b*. Also, the other end portion member 10*g* is provided with a handle member 10*g*1 for stripping off a toner seal which will be described below.

The drawn-out portion 27*a* (see FIG. 8A) of a toner seal member 27 is turned back on one lengthwise end 10*p* (see FIG. 10) side of the toner passage opening 10*k*, and is drawn outwardly through an aperture 10*f*1 1 (see FIG. 11) in the toner developing frame 10*f*1. The end portion 27*a*1 of the drawn-out portion 27*a* of this toner seal member 27 which is drawn outwardly is further drawn outwardly through an aperture 10*g*6 in the end portion member 10*g*, and passes through a through-aperture 10*g*4 in a plate-shaped handle member 10*g*1 which provides a handhold so that the heat-fixable surface R (sealant layer 31 side) of the drawn-out portion 27*a* which is shown in FIG. 8B may become the handle member 10*g*1 side, and is heat-fixed to a predetermined side of the handle member 10*g*1 (see FIG. 6). The handle member 10*g*1 is provided detachably from the end portion member 10*g*. More particularly, the thickness of a connected portion connected to the end portion member 10*g* is made especially small so that it can be bent and separated. Also, the handle member 10*g*1 and the end portion member 10*g* are formed integrally with each other. Preferably, they may be formed integrally with each other by the use of a styrene-based material such as high impact polystyrene (HIPS) or acrylonitrile-butadiene polymer (ABS). The end portion 27*a*1 of the drawn-out portion 27*a* is heat-welded to this handle member.

Figure 6:
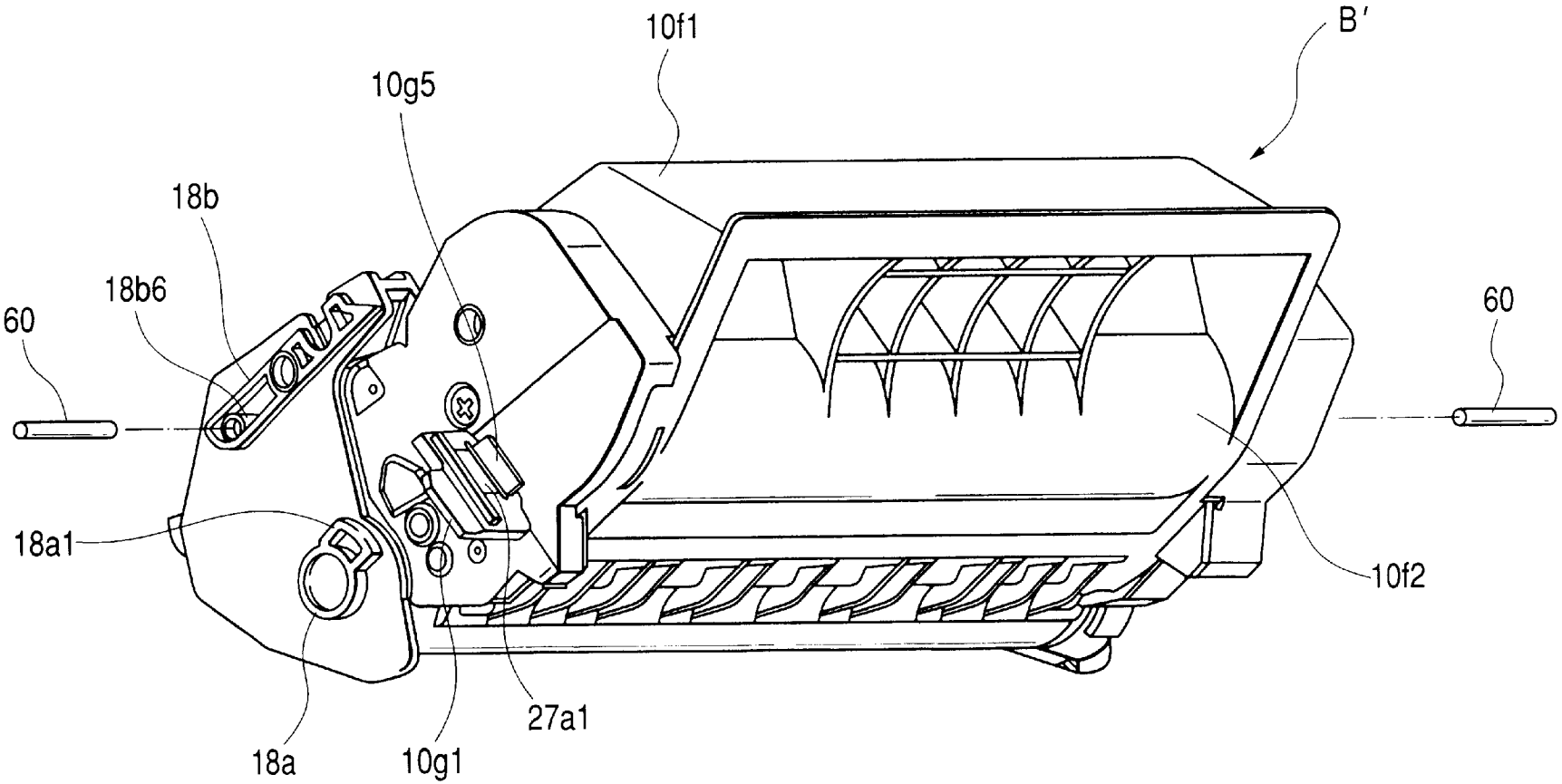
FIG. 6 is an exploded perspective view of the cleaning means and the developing means.
Figure 16:
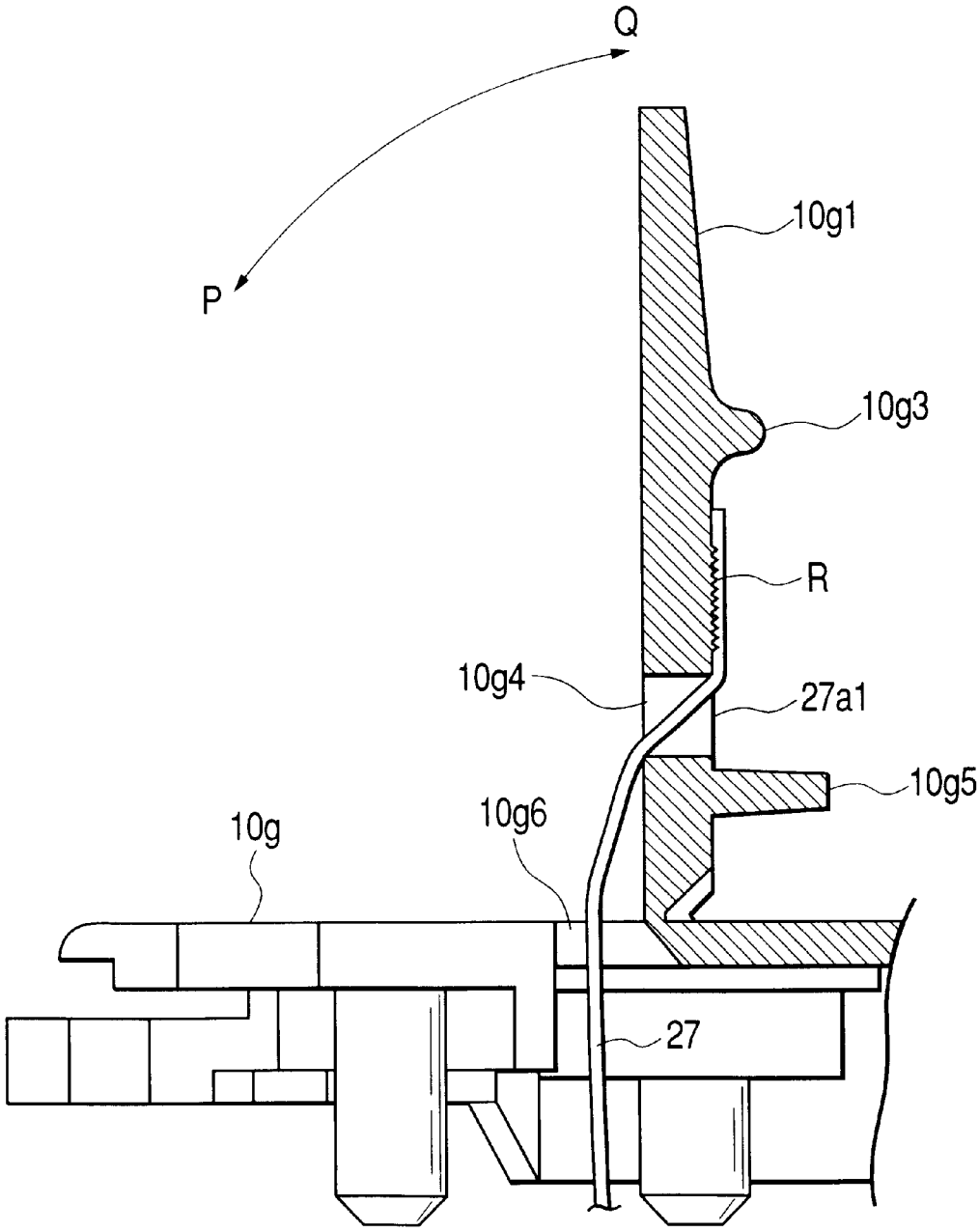
FIG. 16 is a cross-sectional view of an end portion member and a handle member.

The process cartridge B' shown in FIG. 6 which has been assembled as described above is shipped with the handle member 10*g*1 brought down in the direction indicated by the arrow P as shown in FIG. 16 so that it may be contained with the handle member 10*g*1 in a package. The tip end portion of the handle member 10*g*1 is provided with a relief portion (a cut-away 10*g*2 shown in FIG. 11) so that when brought down, it may not interfere with a projected portion 18*a*1 which is the positioning portion of the cleaning frame 11*d*.

Now, as previously described, the holder members (hereinafter referred to as the "end portion members") 10*g* have arm portions 10*g*7 protruding toward the cleaning frame 11*d*, as shown in FIG. 11, and the cleaning frame 11*d* and the end portion members 10*g* can be pivotably coupled together by lengthwise coupling holes 10*g*8 formed in the tip ends of the arms 10*g*7 and pins 60 (see FIG. 6) fitted into coupling holes (not shown) formed in the cleaning frame 11*d*. Compression coil springs having their inner diameters fitted in spring snaps 10*g*9 on the arm portions 10*g*7 are compressedly provided between the arm portions and the cleaning frame 11*d*, and gap holding members (spacers) 10*m* at the opposite ends of the developing roller 10*d* are in pressure contact with the photosensitive drum 7.

Figure 5:
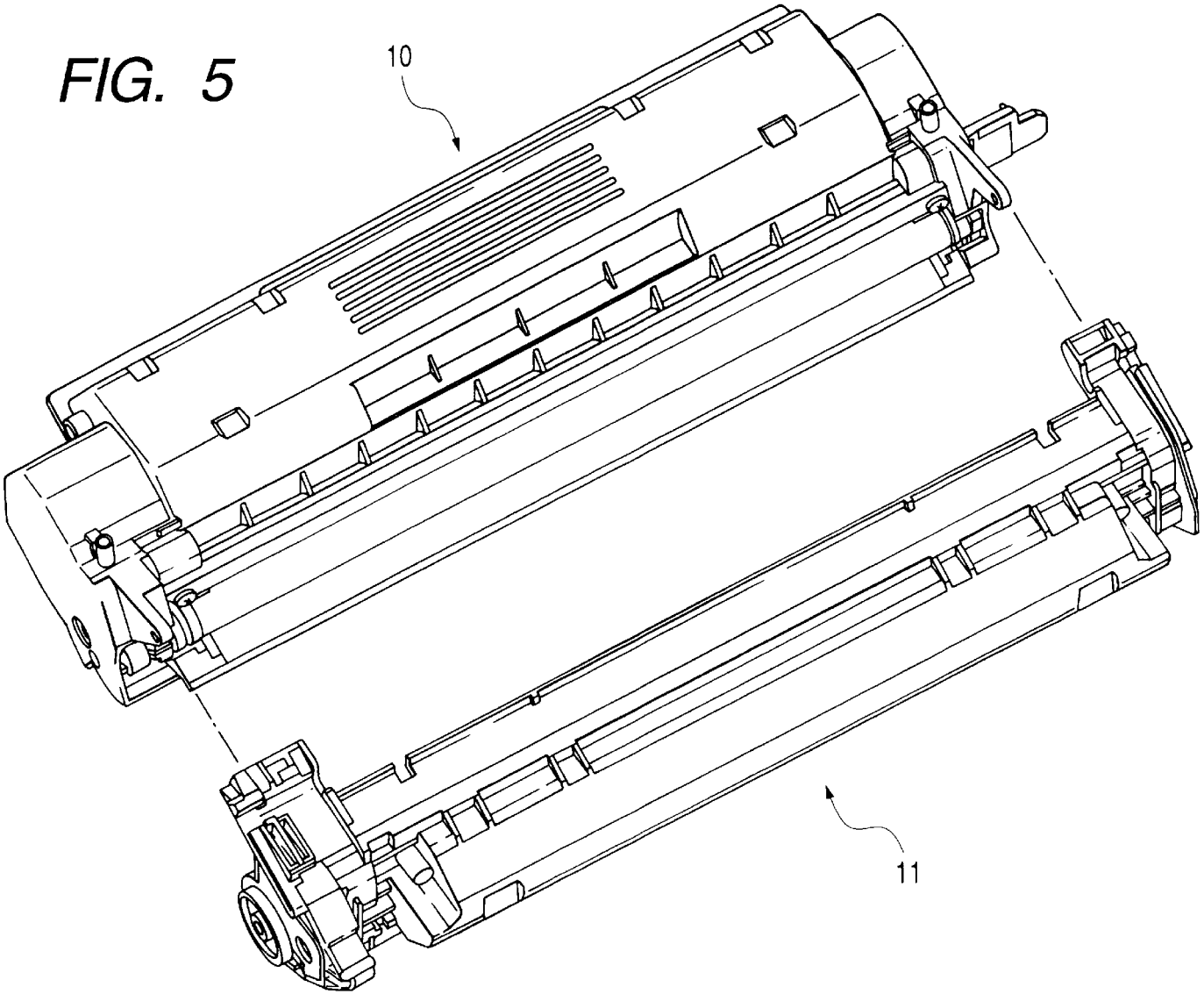
FIG. 5 is an exploded perspective view of cleaning means and developing means.
Figure 7:
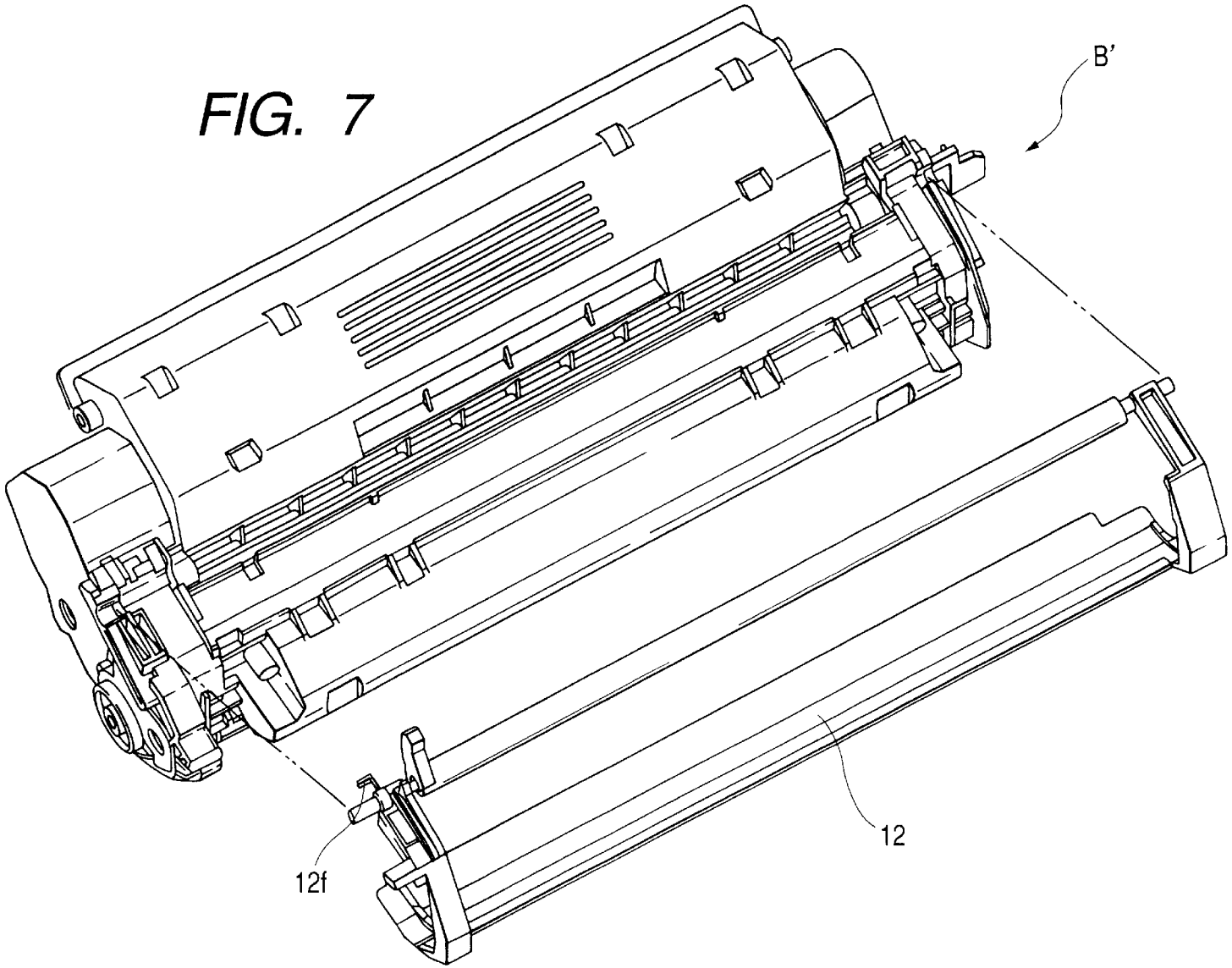
FIG. 7 is an exploded perspective view of the cleaning means and the developing means.

As shown in FIGS. 5, 6 and 7, the cleaning frame 11*d* having the photosensitive drum 7, the cleaning means 11, etc. assembled thereto is coupled to the toner developing frame 10*f*1 and the lid member 10*f*2 made integral with each other as described previously, by pins 60 being inserted through the holes 10*g*8 in the opposite end portion members 10*g* along pin insertion guides 18*b*6 provided inside the mounting guides 18*b*, and forced into apertures (not shown) in the cleaning frame which are coaxial with the pin insertion guides 18*b*6 on the opposite sides of the holes 10*g*8 in the end portion members 10*g*. Further, the shutter 12 and the shutter spring 12*f* are coupled to the cleaning frame 11*d*, whereby the process cartridge B' is assembled.

Figure 17:
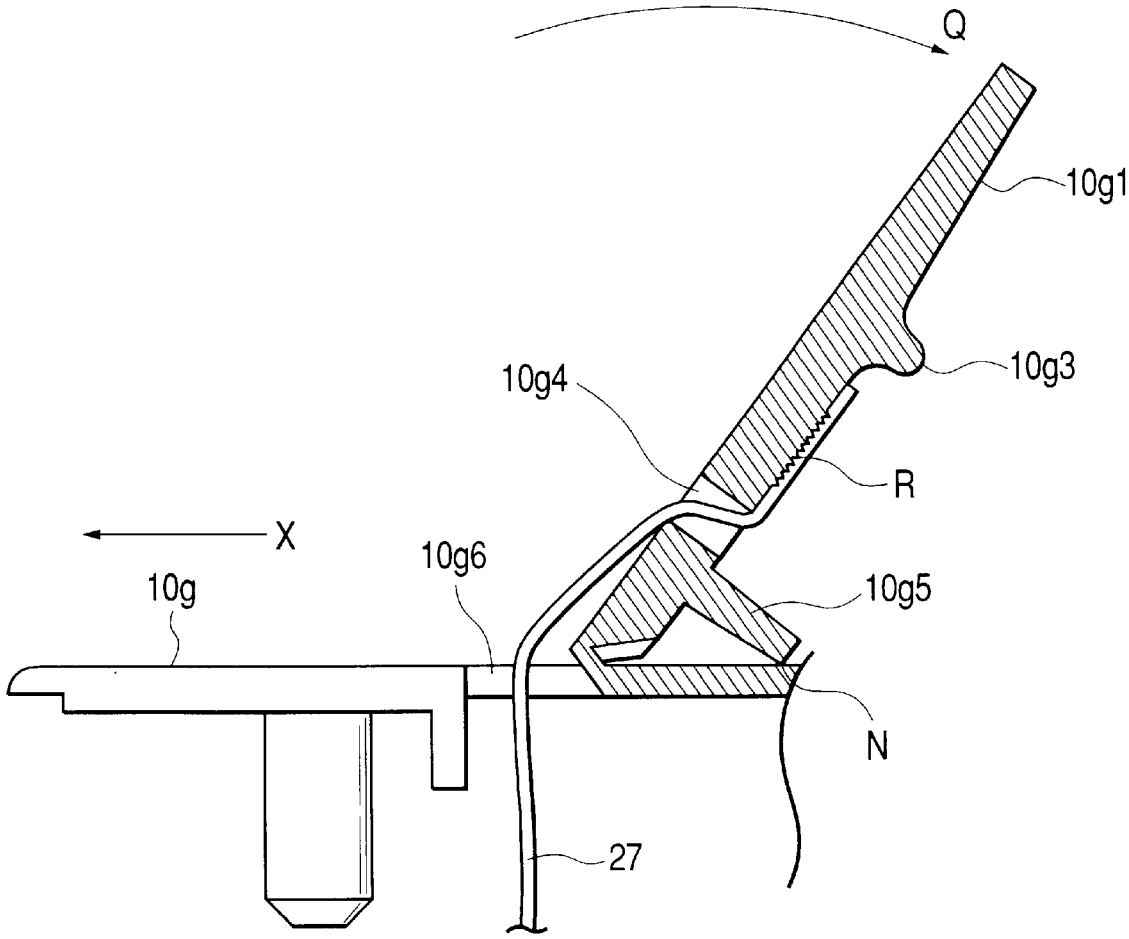
FIG. 17 is a cross-sectional view of the end portion member and the handle member.
Figure 18:
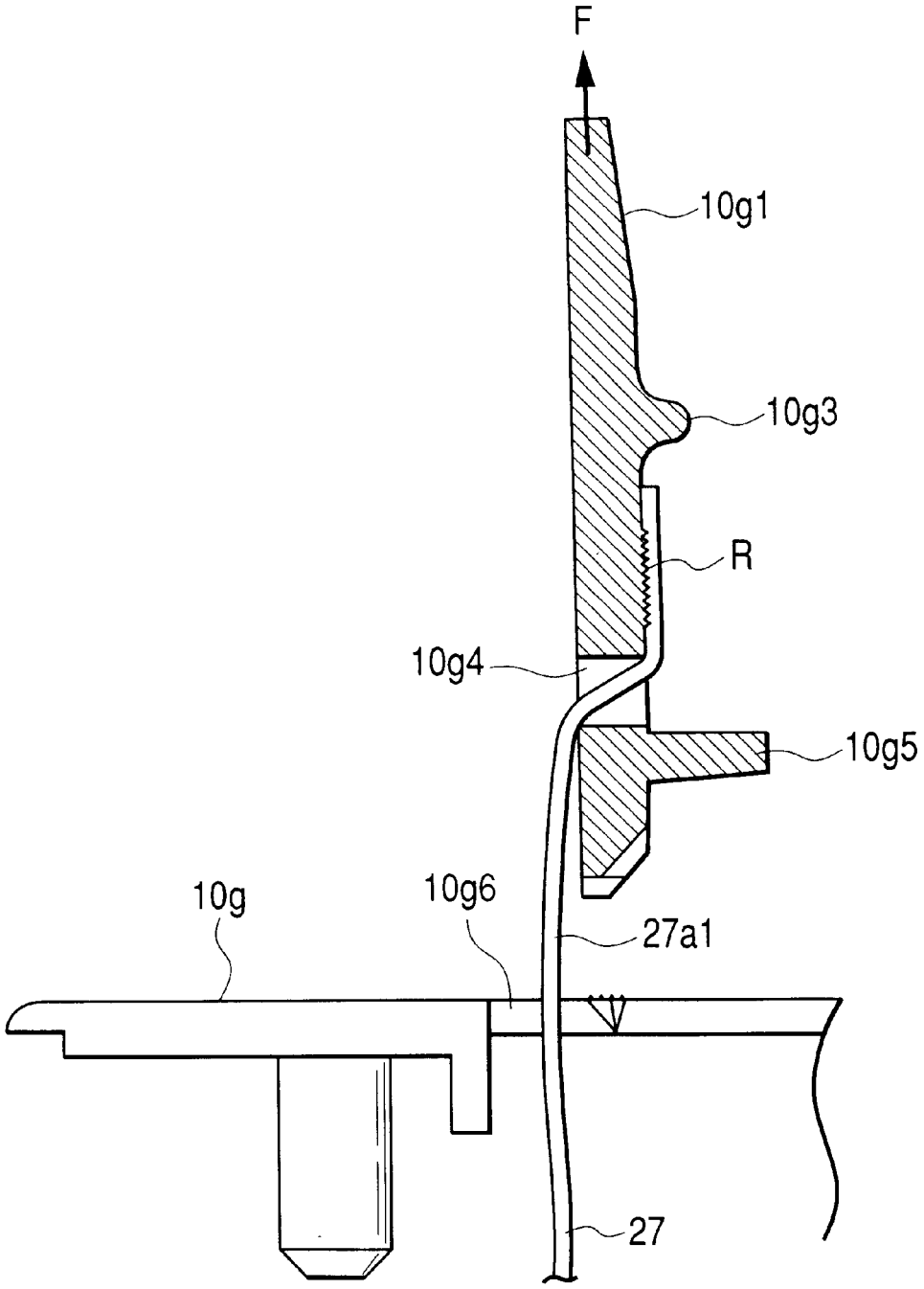
FIG. 18 is a cross-sectional view of the end portion member and the handle member.

When the user brings down the handle member 10*g*1 in the direction indicated by the arrow Q opposite to the direction of insertion of the process cartridge B into the main body 14 of the image forming apparatus as shown in FIG. 17 when he purchases and uses the process cartridge, the tip end portion N of a projection 10*g*5 provided on the handle member 10*g*1 abuts against the end portion member 10*g* and becomes a rotation fulcrum, and the root side (the connected portion to the end portion member 10*g*) of the handle member 10*g*1 is separated from the end portion member 10*g*, and as shown in FIG. 18, the operator catches the convex portion 10*g*3 which is the handhold of the handle member 10*g* by his fingers and pulls it in the direction indicated by the arrow F, whereby the drawn-out portion 27*a* is pulled out and the cover film portion 27*b* is torn, and the toner passage opening 10*k* of the toner developing frame 10*f*1 is unsealed and thus, the toner becomes capable of being fed from the toner chamber 10*a* into the developing chamber 10*i*, and the process cartridge B assumes its state as shown in FIGS. 2 and 4 and becomes ready to be inserted into the main body 14 of the image forming apparatus.

(Process Cartridge Mounting and Dismounting Mechanism)

A description will now be provided of the construction of a process cartridge mounting and dismounting mechanism for mounting and dismounting the process cartridge B on and from the main body 14 of the image forming apparatus.

The process cartridge mounting and dismounting mechanism in the present embodiment is comprised of a movable guide 41 for holding the process cartridge in the main body of the image forming apparatus and movable between the optical system and the transportation means, a cam plate 50 for moving the movable guide 41 at the first half of the closing operation of an opening and closing cover 15 and the second half of the opening operation thereof, a connecting plate 51 for transmitting the rotational movement of the opening and closing cover 15 to the cam plate 50, a push arm for supporting the process cartridge in a position in which it is capable of performing the image forming operation after the movement of the process cartridge, and drum shutter opening and closing means for the drum shutter 12 of the process cartridge.

Further, in the present embodiment, the process cartridge mounting and dismounting mechanism has drive connecting means for effecting the connection and disconnection between image forming apparatus side coupling means and the process-cartridge-side drive transmitting coupling 70 for transmitting a drive force from the right lengthwise end portion to the process cartridge at the second half of the closing operation of the opening and closing cover and the first half of the opening operation thereof, and an interlock switch for detecting the closing of the opening and closing cover and operably supplying electric power to the image forming apparatus. In the closing operation of the opening and closing cover, the process cartridge is transported by the movement of the movable guide 41 operatively associated with the opening and closing cover, and next the coupling means is brought into the state of FIG. 1 in which the coupling means are connectable together by the drive connecting means and also, the push arm is operated, where after the interlock switch is operated. The design of the invention is made such that in the opening operation of the opening and closing cover, the interlock switch is released earlier and next, the drive connecting means and the push arm are released, and lastly, the movable guide is moved.

Also, the shutter 12 starts its opening operation by the cam portion 12*d* abutting against the support plate of the optical system 1 in the transport process of the process cartridge B by the movable guide 41 in the closing operation of the opening and closing cover 15, and as the opening operation progresses further, the rib 12*e* runs onto a shutter guide 44*c*, and further arrives at a shutter guide horizontal position 44*d* on the inner side (see FIG. 24), and the opened state is kept in the position of FIG. 1 which is an image forming position. In the opening operation of the opening and closing cover 15, the shutter 12 can be closed by a converse operation.

(Mounting of the Process Cartridge onto the Main Body)

The mounting and dismounting operation for the process cartridge B by the process cartridge mounting and dismounting mechanism will now be described with reference to FIGS. 19 to 25A and 25B.

Figure 19:
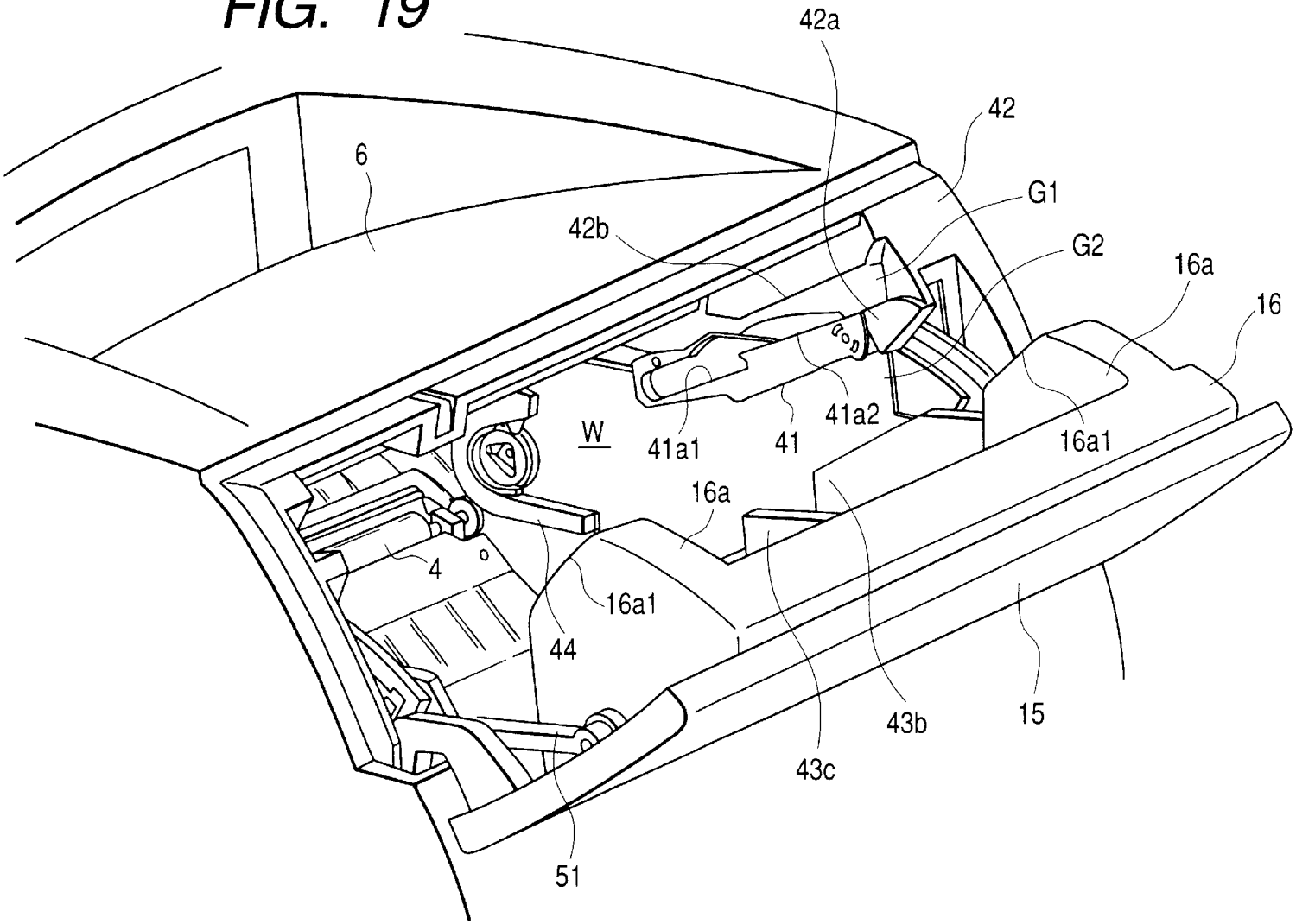
FIG. 19 is a perspective view of a process cartridge mounting and dismounting mechanism.

When the opening and closing cover 15 of the main body 14 of the image forming apparatus is completely opened (fully opened state), an opening W for mounting and dismounting the process cartridge therethrough appears. In this state, as shown in FIG. 19, the movable guide 41 appears in a posture in which it is lowered toward the inner side of the direction of insertion of the process cartridge. On the upstream side of the movable guide 41 with respect to the direction of insertion, auxiliary guides 42 are substantially symmetrically fixed to an inner plate 40 at the left and right side of the main body.

Each auxiliary guide 42 has a mounting and dismounting auxiliary portion 42*a* connecting to the rear end of the movable guide 41, and an upper regulating portion 42*b* having a surface substantially continuing to the upper surface 41*a*6 of the movable guide 41. The mounting and dismounting auxiliary portion 42*a* has a front guide surface 42*a*1 continuing to a guide surface 41*a*2, an introduction guide surface 42*a*2 continuing to the front guide surface 42*a*1 and looser in inclination than the front guide surface 42*a*1 and made substantially horizontal, and a lower guide surface 42*a*3 lying below the front guide surface 42*a*1 and the introduction guide surface 42*a*2 and sharper in inclination than the front guide surface and extending toward the underside of the movable guide 41. Also, the upper regulating portion 42*b* has an upper guide surface 42*b*1 substantially continuing to the upper surface 41*a*6 of the movable guide 41, and an upper introduction guide surface 42*b*2 continuing to the upper guide surface 42*b*1 and substantially parallel to the lower guide surface 42*a*3 and inclined upwardly from the upper guide surface 42*b*1. Also, the side guide 43*b* of a front guide 43 has an inclined surface 43*b*1 made parallel to and somewhat sharper in inclination than the guide surface 41*a*2 of the movable guide 41, and a horizontal surface 43*b*2 continuing to the inclined surface 43*b*1 and provided on the opening and closing cover 15 side.

Figure 13:
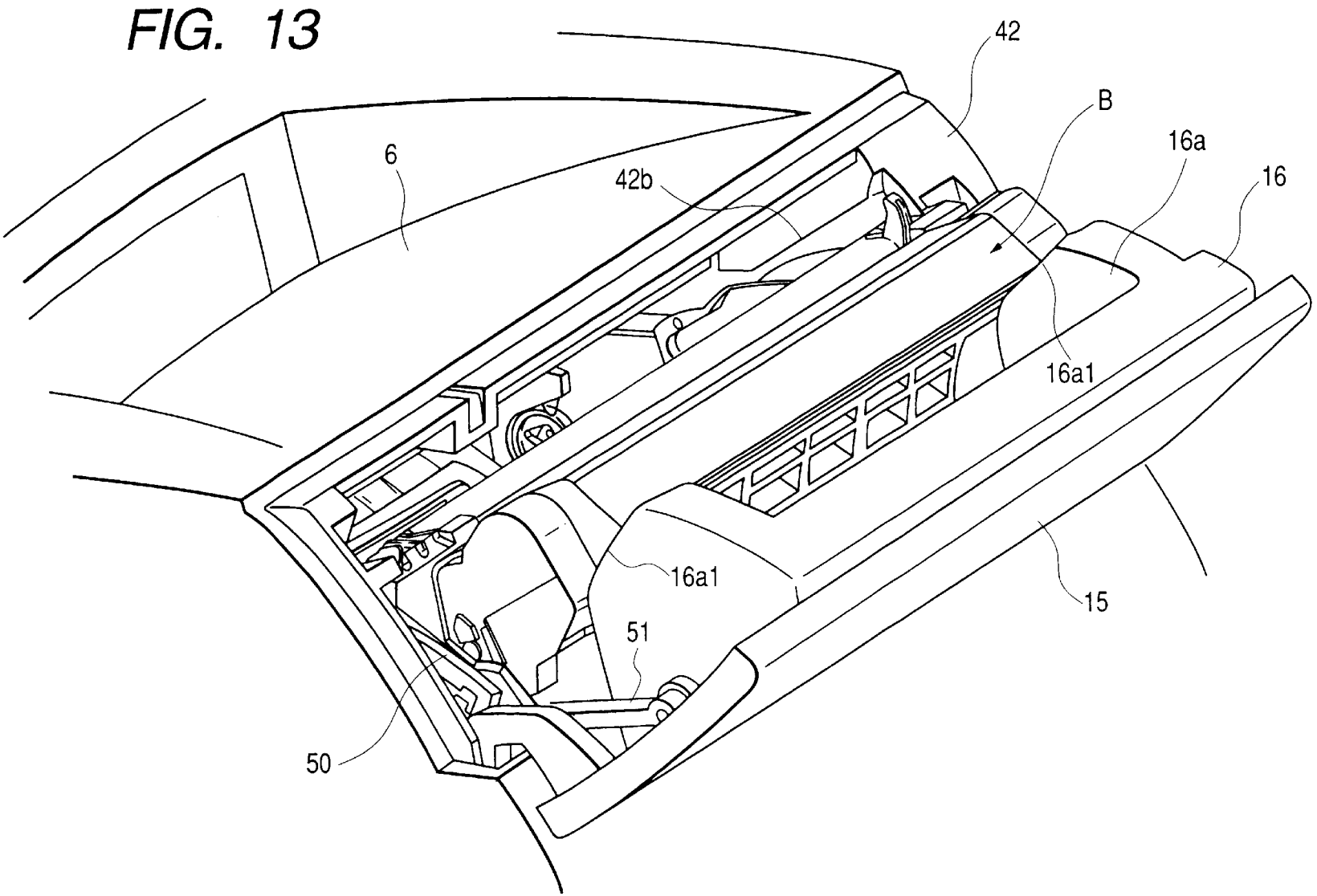
FIG. 13 is a schematic perspective view of the process cartridge as it is inserted into the image forming apparatus.

Therefore, on the inner surfaces of the left and right inner plates 40 of the opening W which appears with the opening and closing cover 15 opened, there appear two guide grooves, namely, an upper guide G1 having its entrance side widened by the introduction guide surface 42*a*2 and the upper introduction guide surface 42*b*2 and constructed among the upper regulating portion 42*b* and the mounting and dismounting auxiliary portion 42*a* of the auxiliary guide 42 and the movable guide 41, and a lower guide G2 having its entrance side widened by the lower guide surface 42*a*3 and the horizontal surface 43*b*2, and constructed among the mounting and dismounting auxiliary portion 42*a* and the movable guide 41 and the side guide 43*b*. Also, the opening and closing cover 15, as shown in FIG. 13, has its central boss 15*a* underlying the cover and therefore, the opening and closing cover 15 is opened downwardly and the back lid 16 faces the opening W. Convex portions 16*a* provided on the back lid 16 are formed with rough guide surfaces 16*a*1 inclined downwardly in the direction of insertion of the process cartridge.

The process cartridge B, as previously described, is provided with positioning portions 18*a* formed on the opposite sides of the cartridge frame CF coaxially with the rotary shaft of the photosensitive drum 7, and a rib-shaped mounting guide 18*b* formed along the direction of mounting and dismounting of the process cartridge. Further, projected portions 10*f*3 are provided on the underside of the toner developing frame 10*f* near the opposite lengthwise ends thereof.

Figure 20:
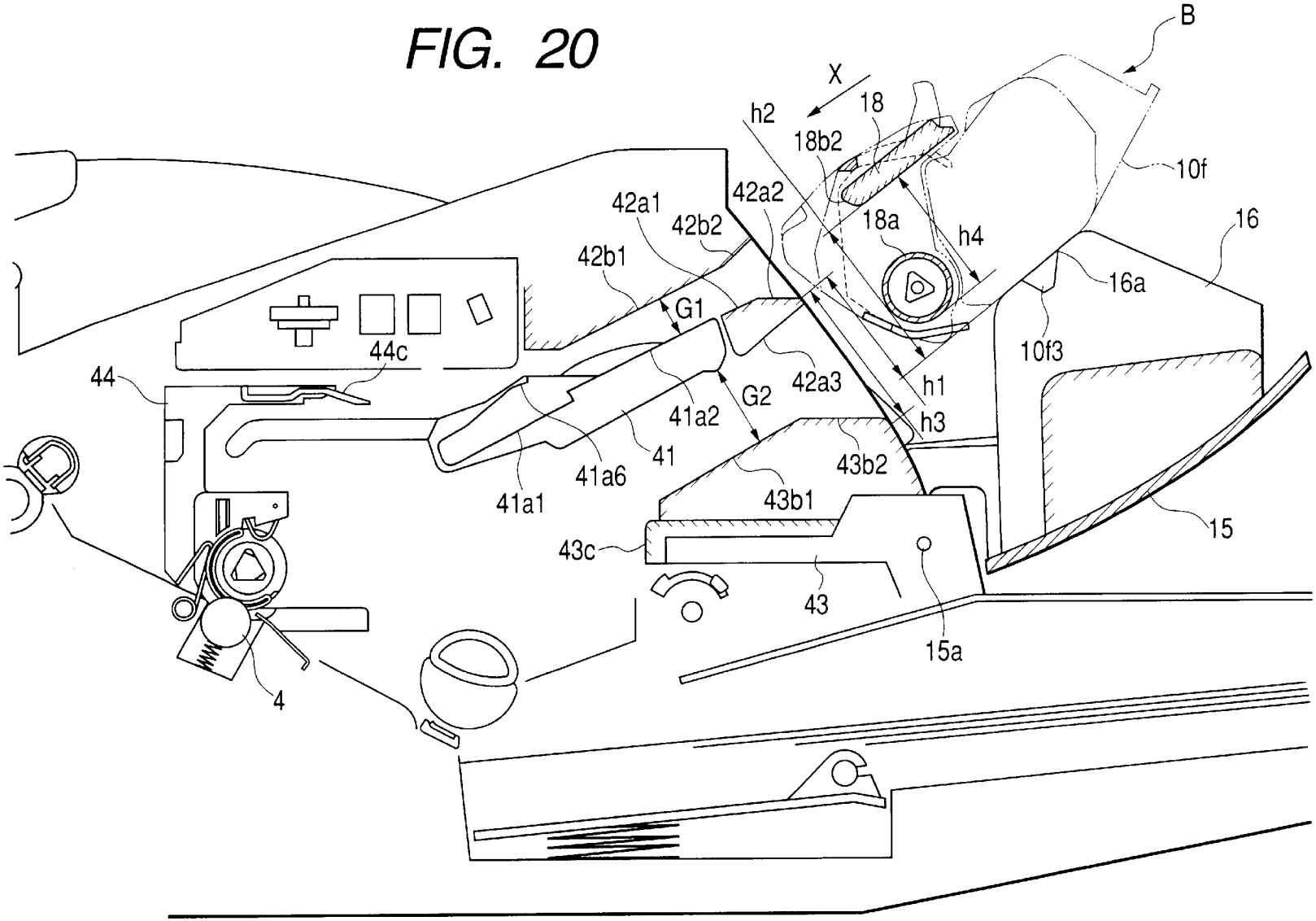
FIG. 20 is a schematic illustration of the operation of inserting the process cartridge into the process cartridge mounting and dismounting mechanism shown in FIG. 19.
Figure 21:
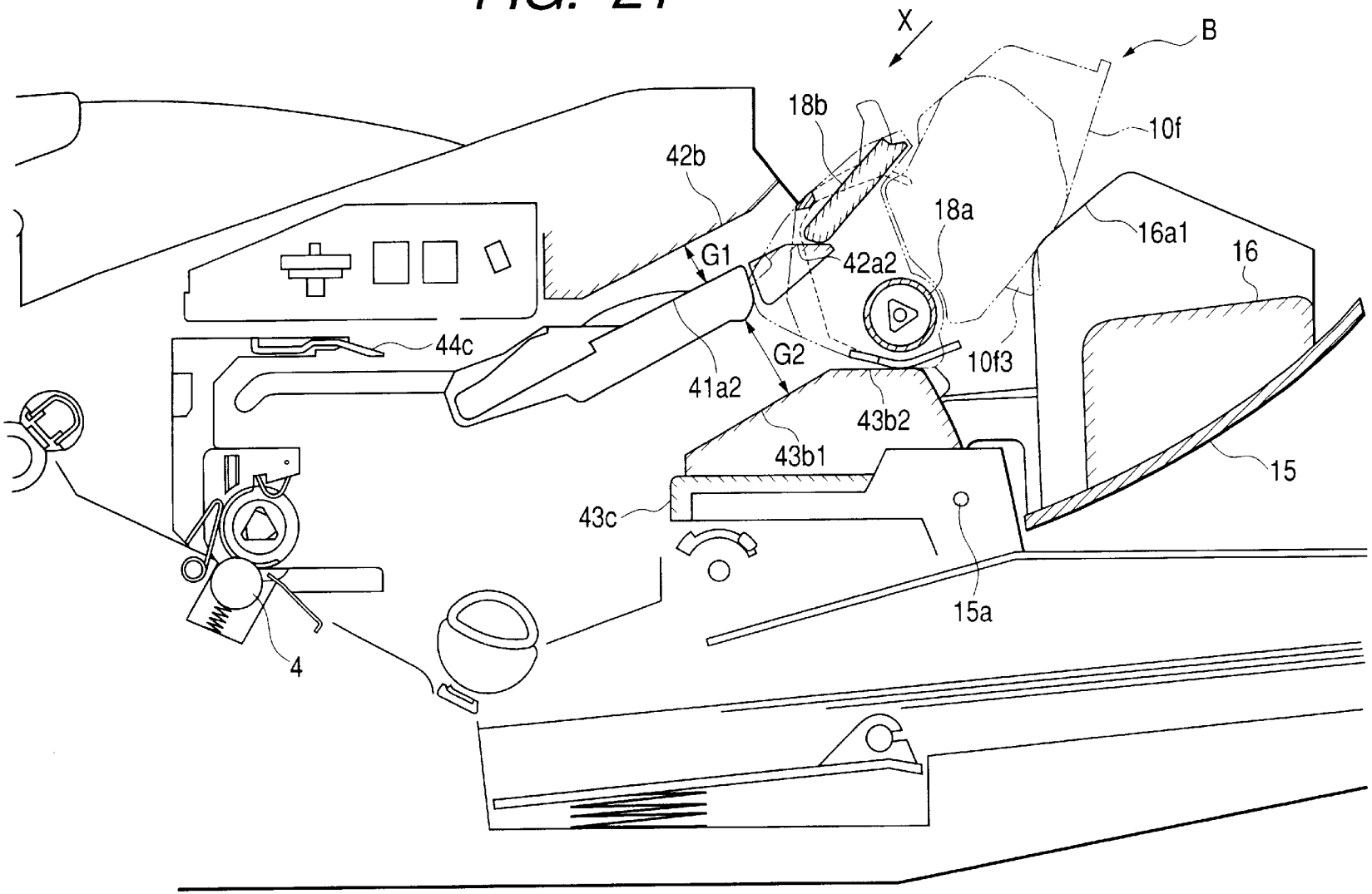
FIG. 21 is a schematic illustration of the operation of inserting the process cartridge into the process cartridge mounting and dismounting mechanism shown in FIG. 19.
Figure 22:
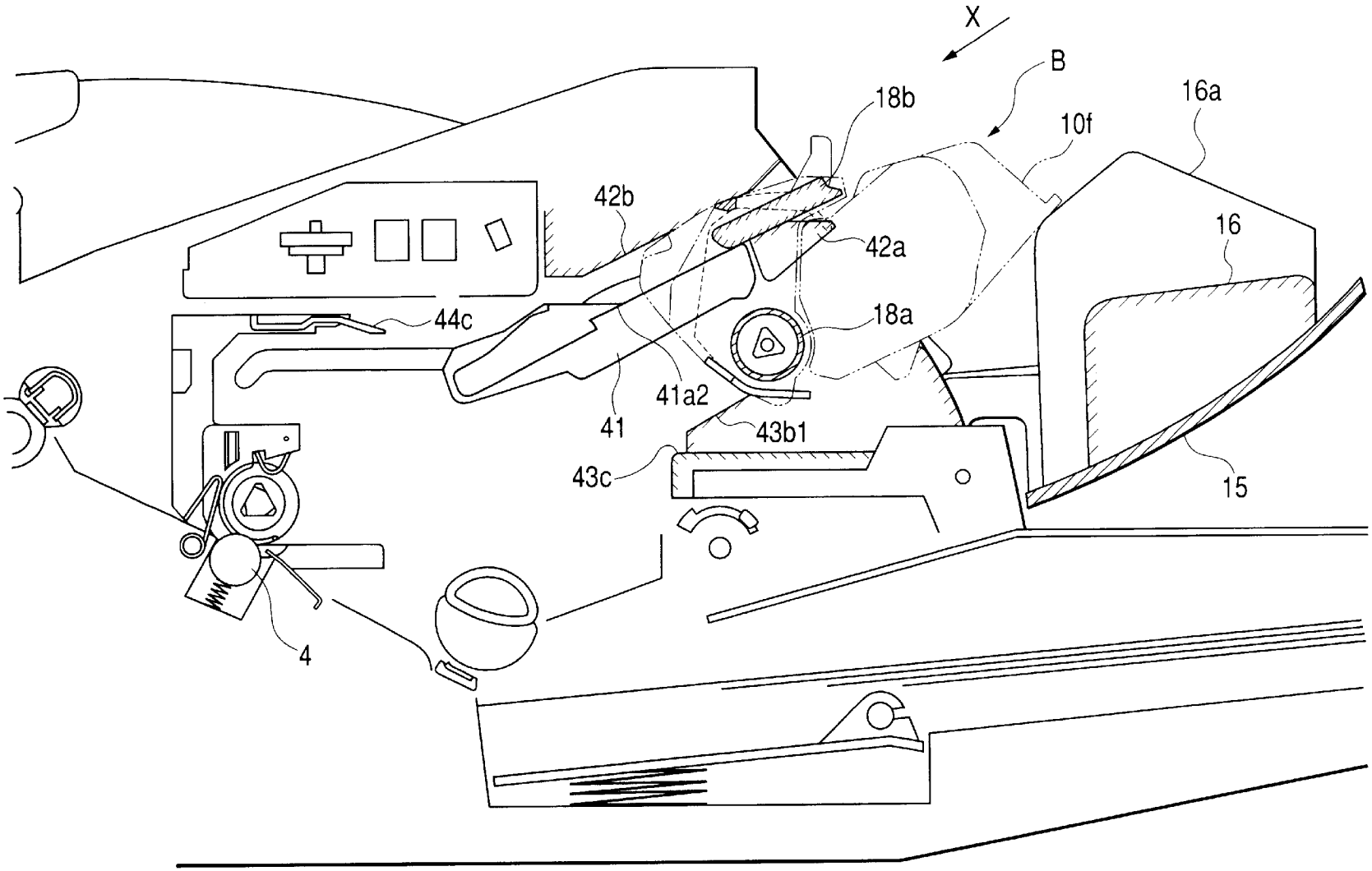
FIG. 22 is a schematic illustration of the operation of inserting the process cartridge into the process cartridge mounting and dismounting mechanism shown in FIG. 19.

When the user is to grasp the grip 10*x* of the cartridge and insert the process cartridge B into the opening W, he inserts the mounting guide 18*b* of the process cartridge B into the upper guide G1 on the side of the opening W with the positioning portion 18*a* adjusted to the lower guide G2 until the mounting guide 18*b* strikes against the inner part of the guide groove 41*a* of the movable guide 41. At this time, the convex portions 16*a* of the back lid 16 act as rough guides for restricting the inserted position of the process cartridge B to a certain degree, and making the mounting guide 18*b* and positioning portion 18*a* of the process cartridge easy to direct to the upper guide G1 and the lower guide G2, respectively. This is designed such that the distance h1 from the rough guide surface 16*a*1 to the opening and closing cover side vertex of the introduction guide surface 42*a*2 and the distance h2 from the underside of the toner developing frame 10*f* to the point of intersection between the underside 18*b*1 and the tip end portions 18*b*2 of the mounting guide 18*b* are set to h1<h2, and the distance h3 from the opening and closing cover side vertex of the introduction guide surface 42*a*2 to the opening and closing cover side vertex of the horizontal surface 43*b*2 of the side guide 43*b* and the distance h4 from the point of intersection between the underside 18*b*1 and the tip end portion 18*b*2 of the mounting guide 18*b* to the underside of the positioning portion 18*a* are set to h3>h4, whereby when as shown in FIGS. 20 and 21, the underside of the toner developing frame 10*f* is disposed along the rough guide surface 16*a*1 provided on the upper surfaces of the convex portions 16*a*, the mounting guide 18*b* and the positioning portion 18*a* are naturally guided to the entrance of the upper guide G1 and the entrance of the lower guide G2, respectively. Also, the convex portions 16*a*, as shown in FIG. 22, contact with the rear end of the toner developing frame 10*f* until the mounting guide 18*b* comes to the guide surface 41*a*2 of he movable guide 41, and the process cartridge B is maintained in its forwardly downwardly facing posture in the mounting directions and therefore, the process cartridge B is made easy to move to the inner part of the guide groove 41*a* of the movable guide 41 with the aid of gravity.

It is for securing a space for permitting the user hand to reasonably come thereinto during the mounting or dismounting of the process cartridge or during jam treatment that the convex portions 16*a* are provided near the opposite lengthwise end portions of the back lid 16 and are made low in the central portion thereof, and this is a shape for the opening W appearing with the opening and closing cover 15 opened to satisfy the requirements for both a restricted area for the mounting of the process cartridge and a space for permitting the user to easily have access to the interior of the image forming apparatus.

Figure 25A:
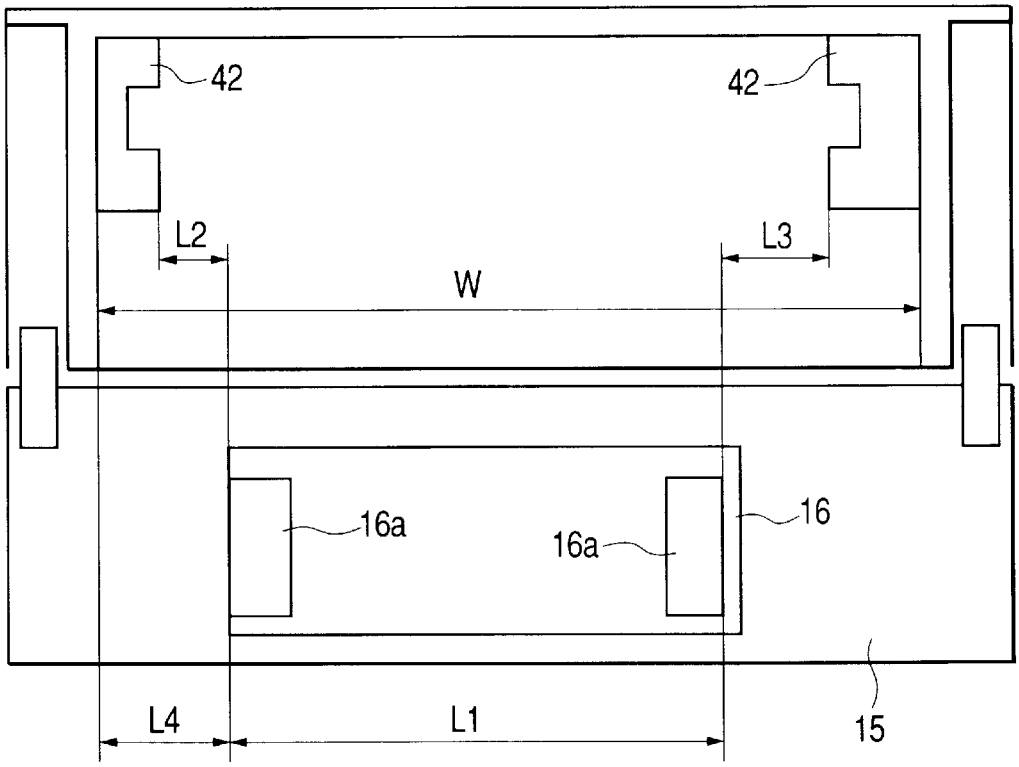
FIGS. 25A and 25B are schematic illustrations of the positional relation in the lengthwise direction between the convex portion of a back lid in an opening W and the projected portion of the process cartridge.
Figure 25B:
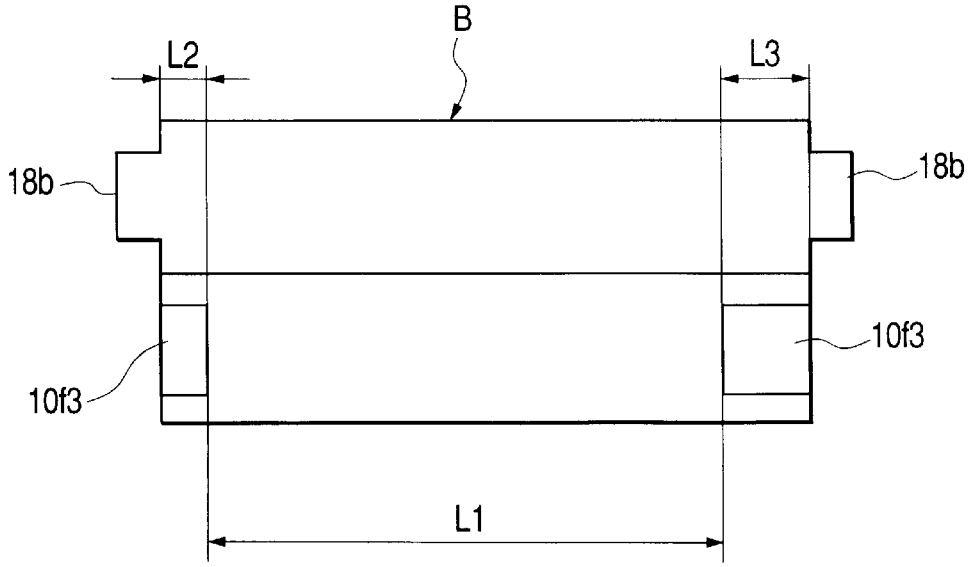
Figure 26B:
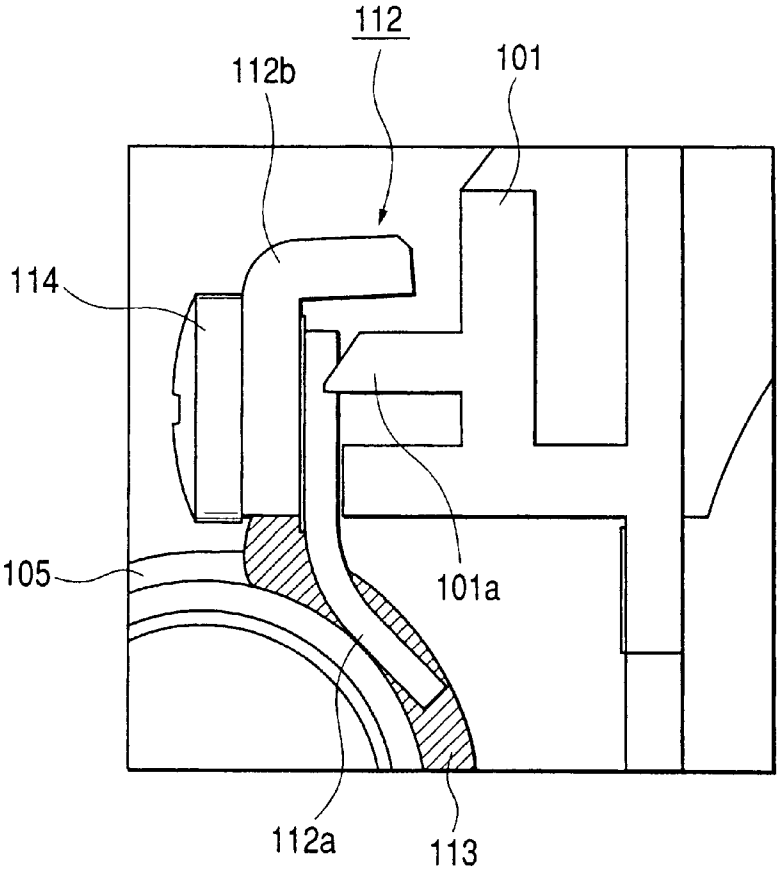
FIG. 26B PRIOR ART
FIGS. 26A and 26B are cross-sectional views of the vicinity of a developing blade according to the conventional art.
Figure 26A:
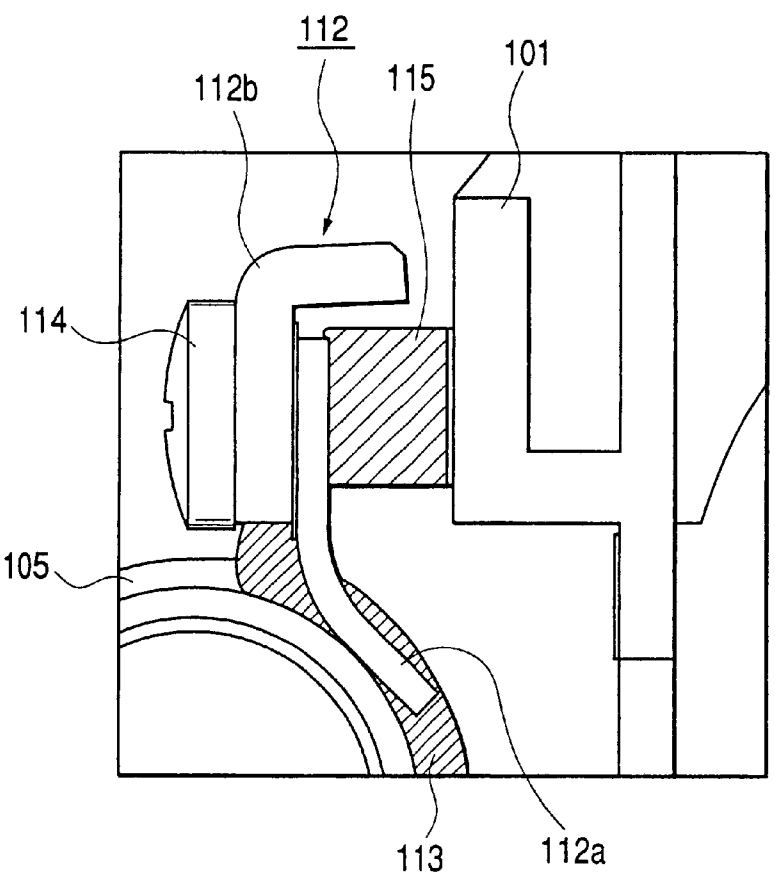
FIG. 26A PRIOR ART
Figure 27:
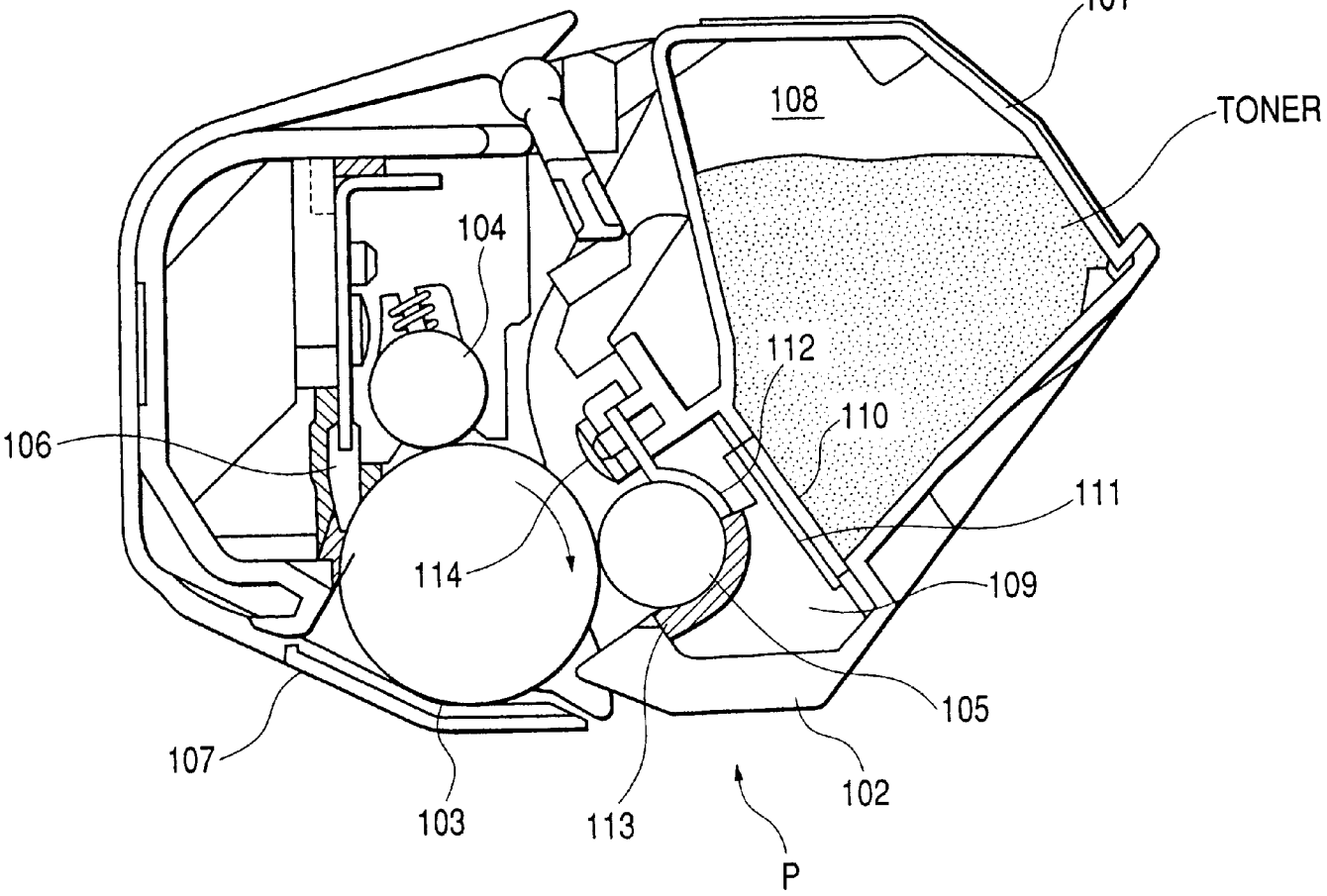
FIG. 27 PRIOR ART
FIG. 27 is a cross-sectional view of a cartridge according to the conventional art.
Figure 28A:
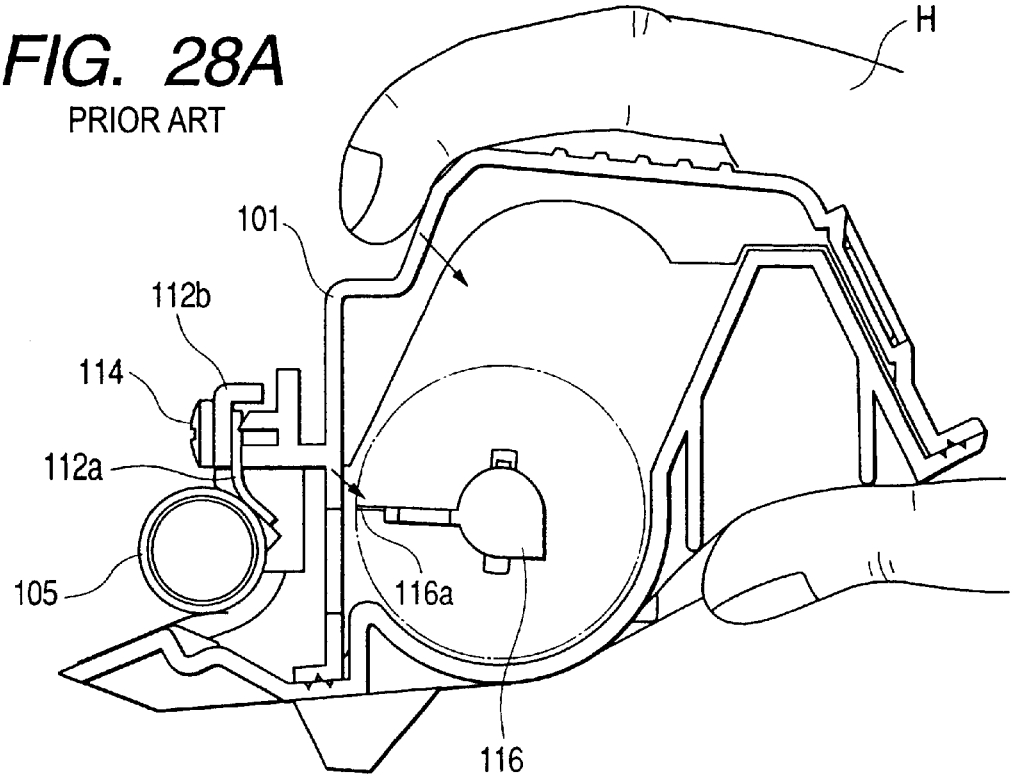
FIG. 28A PRIOR ART
FIGS. 28A and 28B show the deformed states of a frame when the cartridge is grasped by a hand.
Figure 28B:
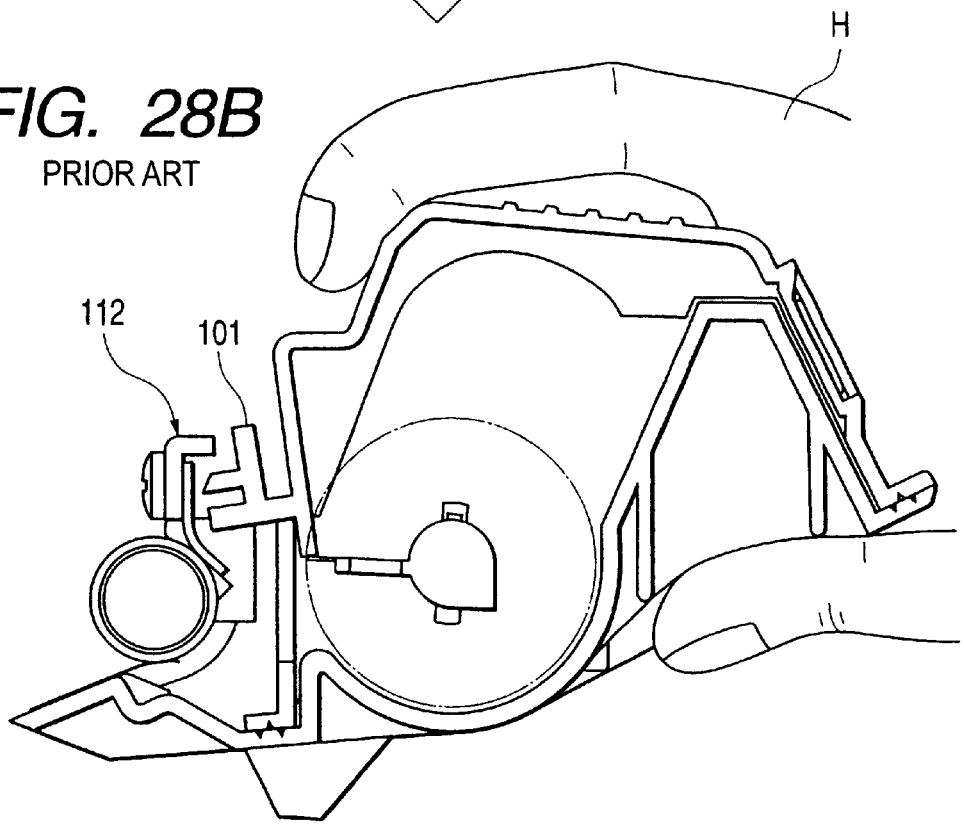
FIG. 28B PRIOR ART
Figure 29:
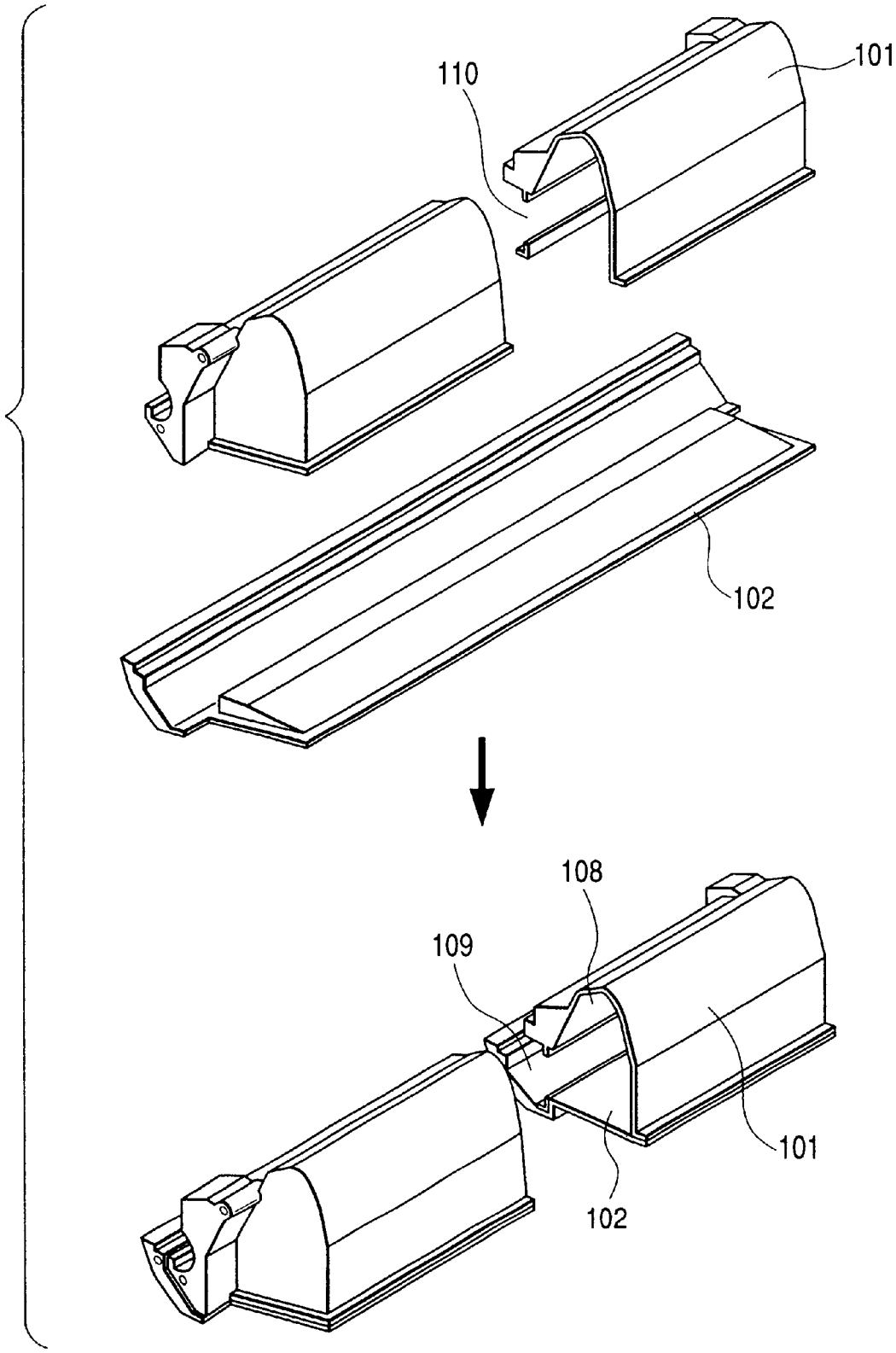
FIG. 29 PRIOR ART
FIG. 29 is an exploded view and an assembled view of a toner container.

The positional relation between the convex portions 16*a* in the opening W and the process cartridge in the lengthwise direction thereof will now be described with reference to FIGS. 25A and 25B. The relations of the interval 11 between the inner sides of the projected portions 10*f*3 of the process cartridge B, the interval 12 between the inner side of the left projected portion and the left side of the cartridge frame CF, and the interval 13 between the inner side of the right projected portion and the right side of the cartridge frame CF to the interval L1 between the outer sides of the convex portions 16*a* of the back lid 16, the interval L2 between the outer side of the left convex portion and the inner surface of the left auxiliary guide, and the interval L3 between the outer side of the right convex portion and the inner surface of the right auxiliary guide are (1)$L1<l1$, (2)$L2\cong l2+(l1-L1)/2+((L1+L2+L3)-(l1+l2+l3))/2$ and (3)$L3\cong l3+(l1-L1)/2+((L1+L2+L3)-(l1+l2+l3))/2$ and therefore, from expression (1), the convex portions 16*a* at the opposite ends are between the projected portions 10*f*3 on the underside of the toner developing frame, and from expressions (2) and (3), the projected portions 10*f*3 are adjusted to the convex portions 16*a*, whereby the rough lengthwise alignment of the process cartridge B with the opening W can be done.

When by the utilization of the thus formed convex portions 16*a* of the back lid 16, the mounting guide 18*b* and the positioning portion 18*a* of the process cartridge B are guided to the upper guide G1 and the lower guide G2, respectively, the process cartridge assumes its forwardly downwardly facing posture because the front guide surface 41*a*1 which is the underside of the upper guide G1 and the guide surface 41*a*2 are formed while being forwardly downwardly inclined and the rear end of the mounting guide 18*b* is provided up to the rear of the centroidal position of the process cartridge, and the process cartridge B is adapted to be guided to the inner part of the movable guide 41 with the aid of gravity. The inclined surface 43*b*1 of the side guide 43*b* which is the underside of the lower guide G2 is somewhat steeper in inclination than the guide surface 41*a*2 and therefore, as the process cartridge is inserted, the positioning portion 18*a* separates from the inclined surface 43*b*1 of the side guide 43*b* (see FIG. 22). Thus, the process cartridge, when inserted through the opening W, is designed to receive the mounting guide 18*b* by the movable guide 41. As the process, cartridge B received by the guide surface 41*a*2 of the movable guide 41 is further inserted, the tip end portion 18*b*2 of the mounting guide 18*b* abuts against the upper inclined surface 41*a*7 of the movable guide 41 (see FIG. 23). The tip end portion 18*b*2 of the mounting guide 18*b* is a smooth arc, and the lower side of the upper inclined surface 41*a*7 is a receiving surface (front guide surface) 41*a*1 lower than the guide surface 41*a*2 and therefore, the process cartridge B is inserted into the inner part of the guide groove 41*a* while changing its posture in a direction to further steepen its inclination than during the mounting thereof by the action of the upper inclined surface 41*a*7, and the tip end portion 18*b*2 of the mounting guide comes into contact with the inner part of the receiving surface 41*a*1, whereupon the mounting of the process cartridge is completed (see FIG. 24).

Figure 23:
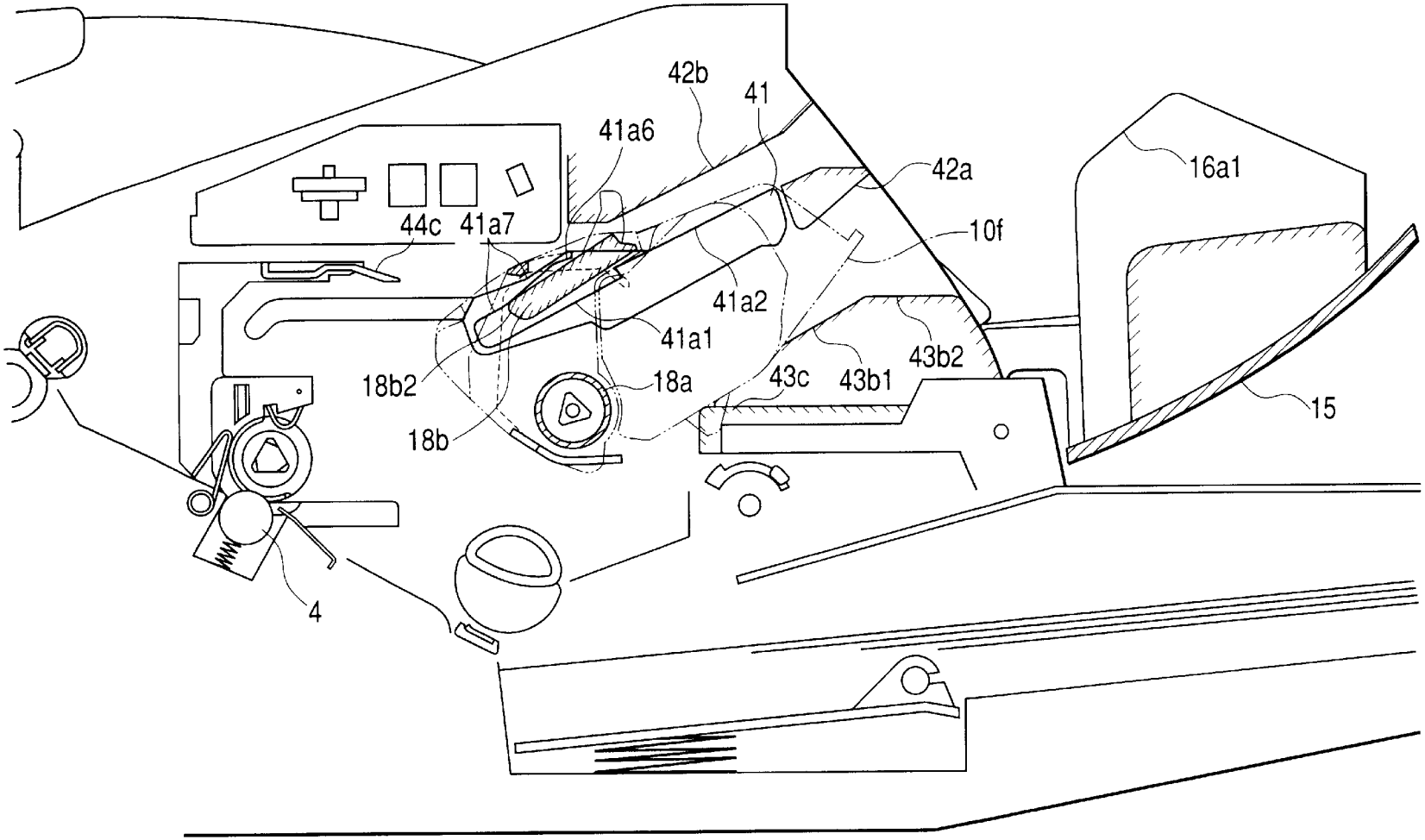
FIG. 23 is a schematic illustration of the operation of inserting the process cartridge into the process cartridge mounting and dismounting mechanism shown in FIG. 19.
Figure 24:
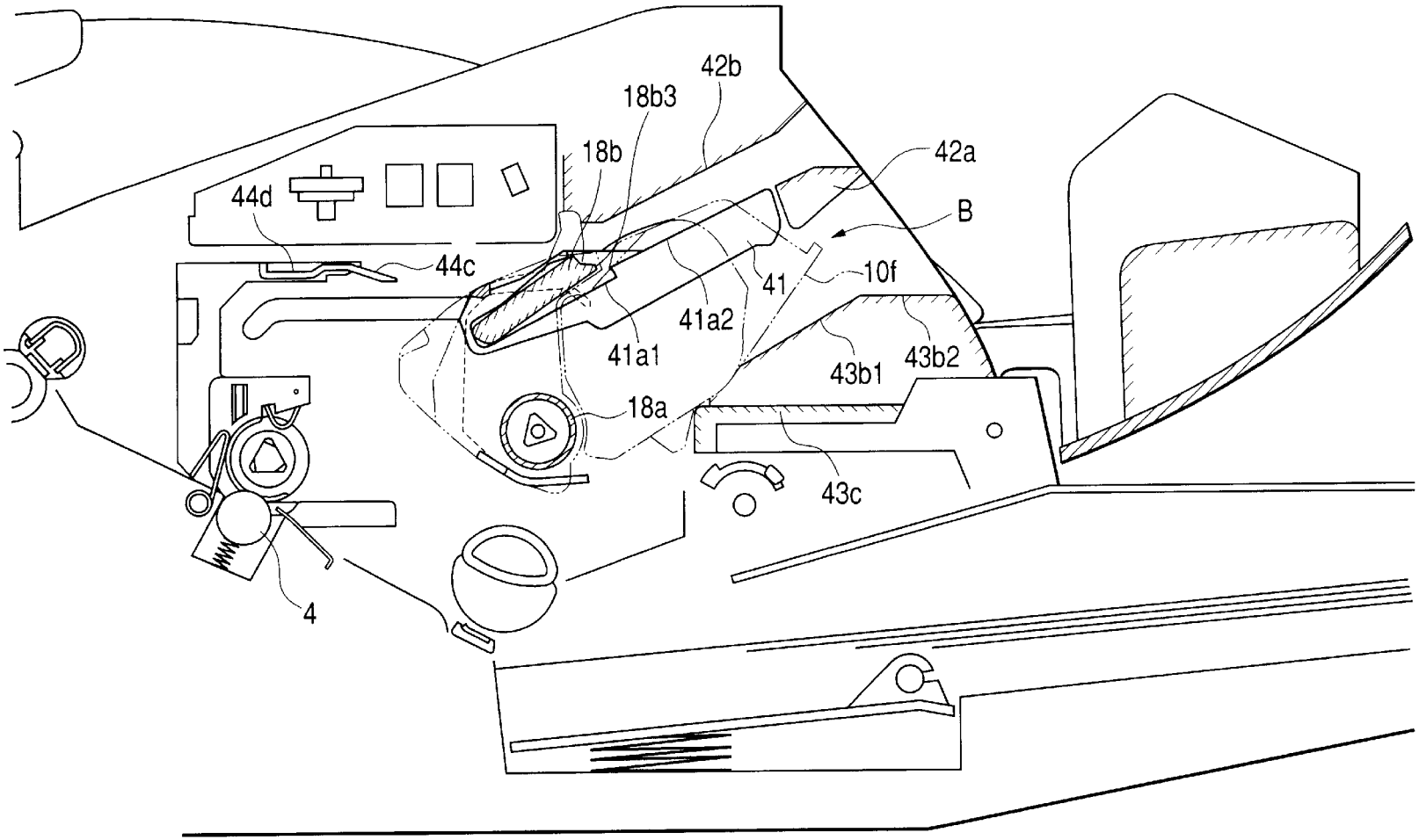
FIG. 24 is a schematic illustration of the operation of inserting the process cartridge into the process cartridge mounting and dismounting mechanism shown in FIG. 19.

When the process cartridge B changes its posture to the posture in the direction to steepen its inclination, the tip end of an abutting rib 43*c* provided on the front guide 43 abuts against the underside of the toner developing frame 10*f*, and with the tip end of this abutting rib 43*c* as a fulcrum, the process cartridge B changes to a further forwardly downwardly facing posture (see FIGS. 23 and 24). The point at which the underside of the toner developing frame 10*f* contacts with the abutting rib 43*c* with the process cartridge B completely inserted is set rearwardly of the centroidal position of the process cartridge B with respect to the direction of insertion and therefore, the process cartridge assumes a posture in which it raises the toner developing frame which is the rear side in the direction of insertion upon completion of the mounting thereof. Therefore, the process cartridge B inserted through the opening W has the underside of the tip end portion 18*b*2 of the mounting guide supported by the inner part of the receiving surface 41*a*1 of the guide groove 41*a* and has the underside of the toner developing frame 10*f* supported by the abutting rib 43*c* of the front guide 43, and the lower corner 18*b*3 of the rear end of the mounting guide 18*b* is raised. The abutting rib 43*c* is set such that the lower corner 18*b*3 of the rear end of the mounting guide 18*b* is substantially at the same height as the guide surface 41*a*2 of the movable guide 41.

The movable guide 41 in the process cartridge mounting and dismounting mechanism according to the present embodiment is designed to be moved in operative association with the opening and closing operation of the opening and closing cover 15. Therefore, if the movable guide 41 is of a construction in which the rear end thereof (the opening and closing cover side end surface) can be pushed by the process cartridge B, the movable guide 41 will escape into the interior of the image forming apparatus and it will become impossible to bring the mounting guide 18*b* of the process cartridge B into the guide groove 41*a* of the movable guide 41. Therefore, in the present embodiment, upstream of the movable guide 41 with respect to the direction of mounting of the process cartridge B (the direction indicated by the arrow X), there is provided an auxiliary guide 42 having a mounting and dismounting auxiliary portion 42*a* fixed to the inner side plate 40 and connecting to the rear end of the movable guide 41. The above-noted problem is solved by this auxiliary guide 42, and the guide rib (mounting guide) 18*b* of the process cartridge B is reliably guided into the guide groove 41*a* of the movable guide 41.

Also, because of a construction in which the process cartridge B is mounted on the movable guide 41 moved in operative association with the opening and closing operation of the opening and closing cover 15, in a state in which the opening and closing cover 15 is closed halfway, the movable guide 41 is moved into the image forming apparatus and therefore, a gap is formed between it and the mounting and dismounting auxiliary portion 42*a* of the auxiliary guide 42. If the amount of closure of the opening and closing cover 15 is small and the gap is of such a degree as can be straddled by the mounting guide 18*b*, it is possible to effect the mounting of the process cartridge. However, when this gap becomes wider to a certain degree, it becomes impossible to bring the mounting guide 18*b* of the process cartridge B into the guide groove 41*a* of the movable guide 41, and when the gap is still wider, it is supposed that the mounting guide 18*b* comes into this gap and gets into the image forming apparatus. Therefore, in the present embodiment, the insertion of the process cartridge with the opening and closing cover 15 closed halfway is prevented by the convex portions 16*a* of the back lid 16.

When the amount of closure of the opening and closing cover 15 is great, the convex portions 16*a* of the back lid 16 become close to the upper regulating portion 42*b* and the space for permitting the process cartridge to be mounted therein becomes null and thus, the process cartridge cannot be inserted. When the opening and closing cover 15 is closed halfway and the process cartridge is still insertable, the convex portions 16*a* enter in the original direction of mounting and dismounting (the direction indicated by the arrow X) by the rotation of the opening and closing cover 15, and the rough guide surfaces 16*a*1 of the back lid 16 becomes steeper in angle than usual and therefore, the process cartridge B becomes insertable only at an angle steeper than usual. When with this opening and closing cover 15 closed halfway, the process cartridge B is inserted at a steep angle in such a manner that the underside of the process cartridge B is along the rough guide surfaces 16*a*1 of the convex portions 16*a*, the tip end surface 18*b*2 of the mounting guide 18*b* comes into contact with the rear end surface of the movable guide 41 because the guide surface 41*a*2 of the movable guide 41 and the introduction guide surface 42*a*2 of the auxiliary cover 42 are discontinuous to each other. At this time, the positioning portion 18*a* comes into contact with the inclined surface 43*b*1 of the side guide 43*b* and the underside of the toner developing frame 10*f* comes into contact with the convex portions 16*a* of the back lid 16, and the posture of the process cartridge B is restricted. As the opening and closing cover 15 is further closed from this state in which three portions, namely, the tip end of the mounting guide 18*b*, the positioning portion 18*a* and the underside of the toner developing frame 10*f* abut against the rear end of the movable guide 41, the inclined surface 43*b*1 of the side guide 43*b* and the convex portions 16*a*, respectively, the movable guide 41 is moved into the interior of the image forming apparatus and the convex portions 16*a* of the back lid 16 are upwardly rotated and therefore, the process cartridge B is counter-clockwisely rotated and at the rear end of the upper surface of the mounting guide 18*b*, the corner thereof with the orthogonal surface 18*b*5 abuts against the upper introduction guide surface 42*b*2 of the auxiliary guide 42, and the opening and closing cover 15 becomes incapable of being closed any further. That is, even if the process cartridge is inserted from the state in which the opening and closing cover 15 is closed halfway, the opening and closing cover 15 cannot be closed and therefore, the problem of the bad mounting of the process cartridge can be obviated.

Here, even when the process cartridge B is inserted from the above-described state in which the opening and closing cover 15 is closed halfway, and the process cartridge B becomes immovable, if the opening and closing cover 15 is rotated again in its opening direction, the movable guide 41 is moved toward the opening W side and pushes the tip end portion 18*b*2 of the mounting guide 18*b* and pulls out the process cartridge B. When the gap between the receiving surface 41*a*1 of the movable guide 41 and the front guide surface 42*a*1 of the auxiliary guide 42 becomes small and the mounting guide 18*b* straddles the gap, the mounting guide 18*b* is within the guide groove 41*a* and the mounting of the process cartridge becomes possible.

While in the aforedescribed embodiment, the seal construction between the developing blade 10*e* and the toner developing frame 10*f*1 has been shown by way of example and described, the present invention is not restricted thereto, but even in the seal construction between the cleaning blade and the cleaning frame, the leakage of the toner can likewise be prevented if a double-sided adhesive tape is likewise stuck on the rubber portion and a portion of the cleaning frame is set so as to protrude thereinto.

Also, while the process cartridge shown in the aforedescribed embodiment has been shown by way of example with respect to a case where a monochromatic image is formed, the process cartridge according to the present invention can also be suitably applied to a cartridge provided with a plurality of developing means for forming plural colors of images (for example, a two-color image, a three-color image or a full-color image).

Also, the electrophotographic photosensitive member is not restricted to the photosensitive drum, but includes the following, for instance. First, a photoconductor is used as the photosensitive member, and photoconductors include, for example, amorphous silicon, amorphous selenium, zinc oxide, titanium oxide and an organic photoconductor (OPC) or the like. Also, as a shape for carrying the photosensitive member thereon, use is made, for example, of a drum shape or a belt shape, and for example, in a drum type photosensitive member, a photoconductor is deposited by evaporation or applied by coating onto a cylinder of an aluminum alloy.

Also, as the developing method, use can be made of one of various developing methods such as the conventional two-component magnetic brush development, the cascade development, the touchdown development and the cloud development.

Also, while in the aforedescribed embodiment, the so-called contact charging method is used as the construction of the charging means, use may be course be made of a construction in which a metal shield of aluminum or the like is provided on the three surrounding sides of a heretofore used tungsten wire and positive or negative ions created by a high voltage being applied to the tungsten wire are moved to the surface of a photosensitive drum to thereby uniformly charge the surface of the drum.

The charging means is not restricted to the roller type, but may also be of the blade (charging blade) type, the pad type, the block type, the rod type or the wire type.

Also, as the cleaning means for removing the toner residual on the photosensitive drum, a blade, a fur brush, a magnetic brush or the like may be used to construct the cleaning means.

Also, the aforedescribed process cartridge is provided, for example, with an electrophotographic photo-sensitive member and at least one of process means. Accordingly, the forms of the process cartridge include, besides the aforedescribed embodiment, for example, one in which an electrophotographic photosensitive member and developing means are integrally made into a cartridge detachably mountable on the main body of the apparatus, and one in which an electrophotographic photosensitive member, developing means and one of charging means and cleaning means are combined together and integrally made into a cartridge detachably mountable on the main body of the apparatus.

That is, the aforedescribed process cartridge refers to at least developing means and an electrophotographic photosensitive member integrally made into a cartridge detachably mountable on the main body of the image forming apparatus. This process cartridge can be mounted and dismounted on and from the main body of the apparatus by the user himself. Accordingly, the maintenance of the main body of the apparatus can be effected by the user himself.

Further, while in the aforedescribed embodiment, a laser beam printer has been shown by way of example as the electrophotographic image forming apparatus, the present invention need not be restricted thereto, but of course can also be used, for example, in an electrophotographic printer such as an electrophotographic copying machine or an LED printer, a facsimile apparatus or a word processor, or an electrophotographic image forming apparatus such as a compound machine of these (a multifunction printer or the like).

As described above, according to the present invention, it is possible to effect the reinforcement of the frame and improve the toner leakage preventing performance by a simple construction, and realize an inexpensive toner leakage preventing construction.

The present invention is not restricted to the above-described embodiment, but covers modifications within the technical idea thereof.

What is claimed is:

1. A cartridge detachably mountable on an image forming apparatus, comprising:

a frame; and a blade member held by said frame, said blade member having an elastic blade and a metal plate configured and positioned to hold said elastic blade, wherein said blade member is fixed to said frame at opposite lengthwise end portions of said metal plate, wherein a double-sided adhesive tape, one side of which is in contact with said frame and the other side of which is in contact with said blade member, is provided between said frame and said blade member.

2. A cartridge according to claim 1, wherein said blade member is fixed to said frame at opposite lengthwise end portions of said metal plate by screws.

3. A cartridge according to claim 2, wherein said double-sided adhesive tape is stuck between the screws at the opposite lengthwise end portions.

4. A cartridge according to claim 1, wherein said double-sided adhesive tape is stuck between said elastic blade and said frame.

5. A cartridge according to claim 4, wherein said double-sided adhesive tape has a function of sealing a space between said frame and said elastic blade.

6. A cartridge according to claim 1, wherein said frame extends into said elastic blade through said double-sided adhesive tape.

7. A cartridge according to claim 1, further comprising a containing portion for containing a developer, and a developer bearing member bearing the developer thereon, and wherein said blade member has a function of regulating a layer thickness of the developer borne on said developer bearing member.

8. A cartridge according to claim 7, wherein said frame has a first part provided with a grip, and a second part coupled to said first part, and said developer bearing member and said blade member are held by said first part.

9. A cartridge according to claim 8, further comprising an image bearing member held by said second part.

10. A cartridge according to claim 1, further comprising an image bearing member, and wherein said blade member has a function of cleaning said image bearing member with said blade member in contact with said image bearing member.

* * * * *

UNITED STATES PATENT AND TRADEMARK OFFICE

CERTIFICATE OF CORRECTION

PATENT NO. : 6,714,749 B2
DATED : March 30, 2004
INVENTOR(S) : Minoru Sato et al.

It is certified that error appears in the above-identified patent and that said Letters Patent is hereby corrected as shown below:

Column 1,
Line 7, “an” (first occurrence) should read -- a --.

Column 2,
Lines 13 and 32, “lengthwisely” should read -- lengthwise --.

Column 9,
Line 20, “aperture 10$f$1 1” should read -- 10$f$11 --.

Column 16,
Line 24, “be” (first occurrence) should read -- of --.

Signed and Sealed this

Seventeenth Day of August, 2004

JON W. DUDAS
*Acting Director of the United States Patent and Trademark Office*